US005499807A

United States Patent [19]

Nakamura et al.

[11] Patent Number: 5,499,807

[45] **Date of Patent: *Mar. 19, 1996**

[54] PAPER FEEDING APPARATUS HAVING A PAPER SEPARATOR WITH A PRESSURE SENSITIVE AND ELECTRICALLY-CONDUCTIVE MATERIAL

[75] Inventors: Hajime Nakamura; Jun Sakakibara, both of Tokyo, Japan

[73] Assignee: Kabushiki Kaisha Toshiba, Kawasaki, Japan

[ * ] Notice: The portion of the term of this patent shall not extend beyond the expiration date of Pat. No. 5,458,324.

[21] Appl. No.: 210,276

[22] Filed: Mar. 18, 1994

[30] Foreign Application Priority Data

Apr. 16, 1993 [JP] Japan ..... 5-112400

[51] Int. Cl.[6] ..... B65H 3/52

[52] U.S. Cl. ..... 271/121; 324/699; 324/701; 492/10; 492/11; 271/263; 271/265.04

[58] Field of Search ..... 271/121–125, 271/261–263, 265; 324/699, 701, 716; 73/865.8; 492/9–11, 59

[56] References Cited

U.S. PATENT DOCUMENTS

| | | | |
|---|---|---|---|
| 2,849,916 | 9/1958 | Nolan | 271/265 |
| 3,182,301 | 5/1965 | Kolb | 271/265 |
| 3,600,591 | 8/1971 | Thier | 271/263 |
| 3,744,047 | 7/1973 | Allen | 271/263 |
| 4,462,587 | 7/1984 | Graef et al. | 271/263 |
| 4,909,499 | 3/1990 | O'Brien et al. | 271/263 X |
| 5,029,837 | 7/1991 | Uchiyama | 271/122 X |
| 5,031,896 | 7/1991 | Winkler | 271/121 X |
| 5,174,562 | 12/1992 | Mizunaga et al. | 271/263 |
| 5,222,157 | 6/1993 | Yoneda et al. | 382/41 |
| 5,238,123 | 8/1993 | Tovini et al. | 271/262 |

FOREIGN PATENT DOCUMENTS

| | | | |
|---|---|---|---|
| 111337 | 8/1980 | Japan | 271/125 |
| 1-203141 | 8/1989 | Japan . | |
| 2-127327 | 5/1990 | Japan . | |
| 3-107174 | 5/1991 | Japan . | |
| 4-52780 | 2/1992 | Japan . | |
| 4-140253 | 5/1992 | Japan . | |

*Primary Examiner*—William E. Terrell
*Assistant Examiner*—Carol L. Druzbick
*Attorney, Agent, or Firm*—Foley & Lardner

[57] ABSTRACT

An automatic paper feeding apparatus is designed to separate and feed originals by means of a separation pad and a feeding roller. A pressure sensitive conductive rubber is used for the separation pad to convert a change in thickness of an original into an electrical signal, thereby detecting a conveyed state, e.g., a multiple paper-conveying error, of the original.

17 Claims, 31 Drawing Sheets

SAMPLING PERIOD 0
0
0
0
0
TIME
LATCH CLOCK

PAPER FEEDING APPARATUS HAVING A PAPER SEPARATOR WITH A PRESSURE SENSITIVE AND ELECTRICALLY-CONDUCTIVE MATERIAL

BACKGROUND OF THE INVENTION

1. Field of the Invention

The present invention relates to a paper feeding apparatus such as an automatic document feeder used for an image forming apparatus such as a copying machine.

2. Description of the Related Art

As a prior art for detecting the thickness of a paper sheet being conveyed, a technique is disclosed in Jpn. Pat. Appln. KOKAI Publication No. 2-127327, in which the displacement of a feeding roller is detected. An embodiment in this official gazette uses a non-contact type minute displacement sensor (e.g., a laser displacement sensor available from Keyence Corporation), which is very expensive and hence is not practical.

The object in detecting the thickness of a paper sheet is to reliably convey a paper sheet by adjusting the pressing force of a pressing roller at a paper feeding section for reversing an original.

An embodiment is disclosed in Jpn. Pat. Appln. KOKAI Publication No. 4-52780, in which double or multiple paper-conveying of sheets is detected, and different paper discharge portions are respectively arranged for sheets which have undergone multiple paper-conveying, and for the remaining normally conveyed sheets, thereby separately processing only sheets which have undergone multiple paper-conveying.

Jpn. Pat. Appln. KOKAI Publication No. 3-107174 discloses an embodiment associated with an automatic original conveying apparatus for conveying an original to a copying machine, in which originals which have undergone a copying operation are counted and displayed on the basis of detection signals from a paper discharge sensor of the automatic original conveying apparatus.

In the first prior art, pressure adjustment is performed only to improve the reliability in conveying a paper sheet. In addition, the means for measuring/detecting the displacement of the feeding roller is expensive and hence is not practical.

In the second prior art, the following problems are posed in the method of detecting the displacement amounts of the convey rollers by using the displacement sensor.

In this embodiment, it is described that the resolution of the displacement sensor is about 1 to 10 μm. In addition, since the precision of the outer diameter of each roller for conveying a sheet is 5 to 10 μm, fluctuations in displacement data are large before any displacement of a sheet is detected. Therefore, it is difficult to detect a multiple paper-conveying error in practice.

In the use of the means for detecting the thickness of an original by using the capacitance sensor, when the capacitance of a conveyed sheet is low, or the humidity is high, the thickness detection result obtained with respect to the same original differs from that obtained in a normal condition.

When a document is linearly set, the thickness of the document can be accurately expressed by a change in capacitance. If, however, an original is curled, or the degree of curling of an original changes between the electrodes of the detector, it is difficult to accurately detect the thickness of the original.

Assume that trial reading of originals is performed once, and multiple paper-conveying errors are detected on the basis of the resultant thickness and length data. In this case, if the frequency of multiple paper-conveying errors is different from that in the trial read operation, errors may occur in determination of multiple paper-conveying.

In the third prior art, the number of originals which have undergone a copying operation is counted by the paper discharge sensor of the automatic original conveying apparatus to be displayed. In this case, a user must count the number of originals set on the automatic original conveying apparatus in advance, and compare the count value with the displayed count value, thereby detecting a multiple paper-conveying error by himself or herself. It is apparent that when a large quantity of documents are to be copied, communicated, or stored in a medium such as an optical disk, this method imposes a large load on the user.

For an apparatus for feeding a paper sheet, especially an original, it is very important to detect a multiple paper-conveying error. An automatic paper feeding apparatus is used for a facsimile apparatus, an optical disk file apparatus, and the like as well as a copying machine.

In a facsimile apparatus or an optical disk file apparatus designed to convert original image information into an electrical signal, a multiple paper-conveying error poses a serious problem. In a facsimile apparatus, a multiple paper-conveying error cannot be determined from copied paper sheets, and omission of information due to a multiple paper-conveying error is often informed upon an inquiry from the user at the destination. This situation is inconvenient for the user at the destination, and facsimile communication must be repeated.

In an optical disk file apparatus, when image information is converted into an electrical signal and stored in a recording medium such as an optical disk, in order to check a multiple paper-conveying error, the stored information must be read from the optical disk to be checked on a display means such as a CRT. This greatly reduces the effect of office automation (OA) based on an optical disk file apparatus capable of storing a large amount of information.

As described above, the importance of detection of a multiple paper-conveying error has been recognized. However, no attempts have been made to devise a means for realizing such detection.

SUMMARY OF THE INVENTION

It is accordingly an object of the present invention to provide a paper feeding apparatus wherein a pressure sensitive conductive rubber is used for a feeding/rotating member, and a multiple paper-conveying error is detected by converting a change in thickness of an original into an electrical signal so that multiple paper-conveying of an original can be reliably detected. Then, an image read operation or an image forming operation with use of the paper feeding apparatus can be continued immediately after the detection of a multiple paper-conveying error.

According to the present invention, there is provided a paper feeding apparatus comprising storage means for storing a plurality of paper sheets, conveying means for conveying a paper sheet, pickup means for picking up and conveying the paper sheets stored in the storage means one by one to the conveying means, feeding/rotating means, arranged at the conveying means, for feeding a paper sheet picked up by the pickup means, and separation means which is kept in contact with the feeding/rotating means to separate a second or subsequent paper sheet picked up from the pickup means from the first paper sheet, wherein the separation means is constituted by a pressure sensitive conductive rubber whose resistance value changes in accordance with a pressure applied thereto, and outputs a pressure, which accompanies feeding of a paper sheet fed between the separation means and the feeding/rotating means, as a change in resistance value through the pressure sensitive conductive rubber.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described below with reference to the accompanying drawings.

Figure 1:
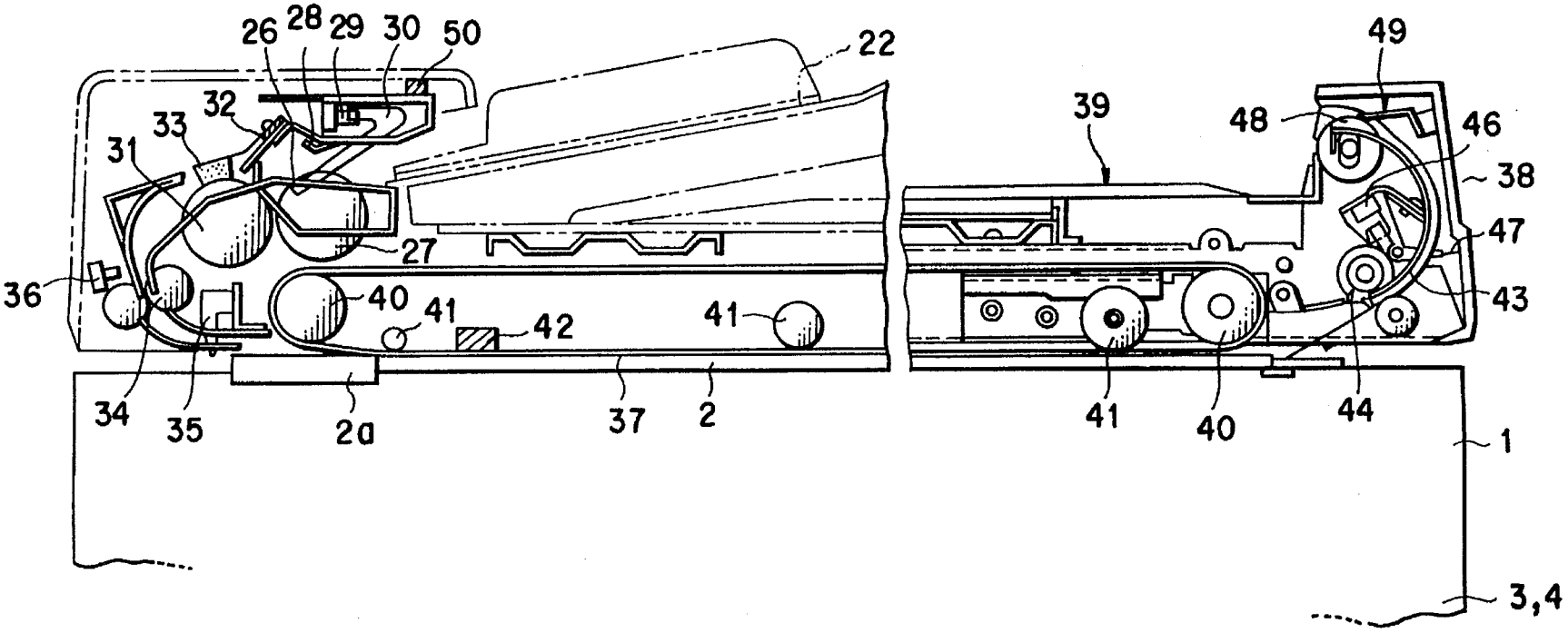
FIG. 1 is a sectional view showing the schematic arrangement of a copying machine as an image forming apparatus according to an embodiment of the present invention.

FIG. 1 shows a copying machine as an image forming apparatus according to the present invention.

Referring to FIG. 1, reference numeral 1 denotes a copying machine body, on which automatic document feeder (ADF) 20 as a paper feeding apparatus of the present invention is mounted. Automatic document feeder 20 is designed to automatically convey original (paper sheet) O.

Original table (transparent glass) 2 is disposed on the upper surface of copying machine body 1. Original O fed from automatic document feeder 20 is placed on original table 2.

Original scanner unit 3 for scanning and reading original O set on original table 2 is arranged in copying machine body 1. Image forming nit 4 is arranged at a lower portion in copying machine body 1. Original table 2 is fixed to copying machine body 1.

Image forming unit 4 is constituted by, e.g., an image forming unit obtained by combining a laser optical system and an electrophotographic scheme capable of forming an image on a transfer sheet.

The arrangement of automatic document feeder 20 will be described next with reference to FIG. 1.

Automatic document feeder 20 is formed as a unit. The rear edge portion of cover body 21 as a housing of this unit is attached to the rear edge portion of the upper surface of copying machine body 1 via a hinge unit (not shown) so as to be freely opened/closed. With this arrangement, overall automatic document feeder 20 can be pivoted/displaced, as needed, to ensure a space on original table 2.

As shown in FIG. 1, original feeding table 22 as an original holding means capable of holding a plurality of originals O en bloc is arranged on the upper surface of cover body 21 at a slightly left position.

In addition, automatic document feeder 20 has picking up/feeding means 23 for sequentially picking up originals O, which are held on original feeding table 22 with their image-bearing surfaces facing up, one by one, from original O at the lowermost position, and feeding them to one end side (the left end side in FIG. 1) of original table 2.

Picking up/feeding means 23 has the following arrangement.

Horizontal U-shaped paper feeding path 25 is arranged to cause the inclined end portion of original feeding table 22 to communicate with the upper surface portion of stopper 2a arranged along the left edge of original table 2. With this arrangement, original O is reversed and guided with its image-bearing surface facing down.

Shutter 26 for aligning the end faces of originals O set on original feeding table 22 is arranged on an upstream portion of paper feeding path 25. Pickup roller 27, weight board 28, empty sensor 29, and actuator 30 for empty sensor 29 are disposed near shutter 26. Pickup roller 27 serves to pick up original O. Weight board 28 urges original O against pickup roller 27. Empty sensor 29 serves as an original sensor for detecting a set state of original O on original feeding table 22.

Furthermore, feeding roller 31 and separation pad 33 mounted on frame 32 and lightly urged against feeding roller 31 are arranged in the original pickup direction of pickup roller 27. With this arrangement, originals O can be reliably fed one by one. Separation pad 33 incorporates pressure sensitive conductive rubber 33*a* (to be described later) as a separation rubber for detecting the thickness of original O, a conveyed state, e.g., multiple paper-conveying of originals O, and the opened/closed state of automatic document feeder 20. Both friction coefficient $\mu_{bs}$ between pressure sensitive conductive rubber 33*a* of separation pad 33 and original O and friction coefficient $\mu_{rs}$ between feeding roller 31 and original O are larger than friction coefficient $\mu_{ss}$ between originals O. Therefore, only original O at the lowermost position is separated and conveyed until it is brought into contact with aligning rollers 34.

Aligning rollers 34 as a resist roller pair for correcting a ramp (skew) of original O and regulating a feed timing are arranged on an upstream portion of paper feeding path 25, together with resist sensor 36 located in front of aligning rollers 34 and designed to detect original O and regulate the operation timing of aligning rollers 34. In addition, an original size sensor for detecting original O and detecting the size of original O is arranged on the downstream side of aligning rollers 34.

Original convey belt 37 as an original convey means extends to cover the upper surface of original table 2. Original O fed by picking up/feeding means 23 is conveyed from one end side (left end side) to the other end side (right end side) of original table 2, and is discharged onto discharged paper receiving portion 39, formed on the upper surface of cover body 21, by paper discharge means 38 disposed on a right side portion of cover body 21.

Original convey belt 37 is constituted by a wide endless belt having a white outer surface and looped around a pair of belt rollers 40, and is driven in the forward and reverse directions by a belt driving mechanism (not shown) to be described later. A plurality of belt pressing rollers 41 and SET switch 42 are arranged on the inner lower surface side of original convey belt 37. Belt pressing rollers 41 serve to press the belt surface against original table 2. SET switch 42 is used as a cancellation switch when a jam occurs.

Paper discharge means 38 has the following arrangement.

Horizontal U-shaped paper discharge path 43 is arranged to cause the right edge of original table 2 to communicate with discharged paper receiving portion 39 so that original O is reversed and discharged with its image-bearing surface facing up.

Convey roller 44, pinch roller 45, paper discharge sensor 46, and actuator 47 for paper discharge sensor 46 are arranged at an intermediate portion of paper discharge path 43. Pinch roller 45 urges original O against convey roller 44. Paper discharge sensor 46 serves as an original detecting means for detecting the trailing end of original O conveyed in the discharging direction.

Paper discharge roller 48 is arranged on the downstream side of paper discharge path 43, together with leaf spring 49 for urging original O against paper discharge roller 48.

Referring to FIG. 1, reference numeral 50 denotes a cover switch.

The operation of automatic document feeder 20 having the above-described arrangement will be described next with reference to FIGS. 2 to 6.

Figure 2:
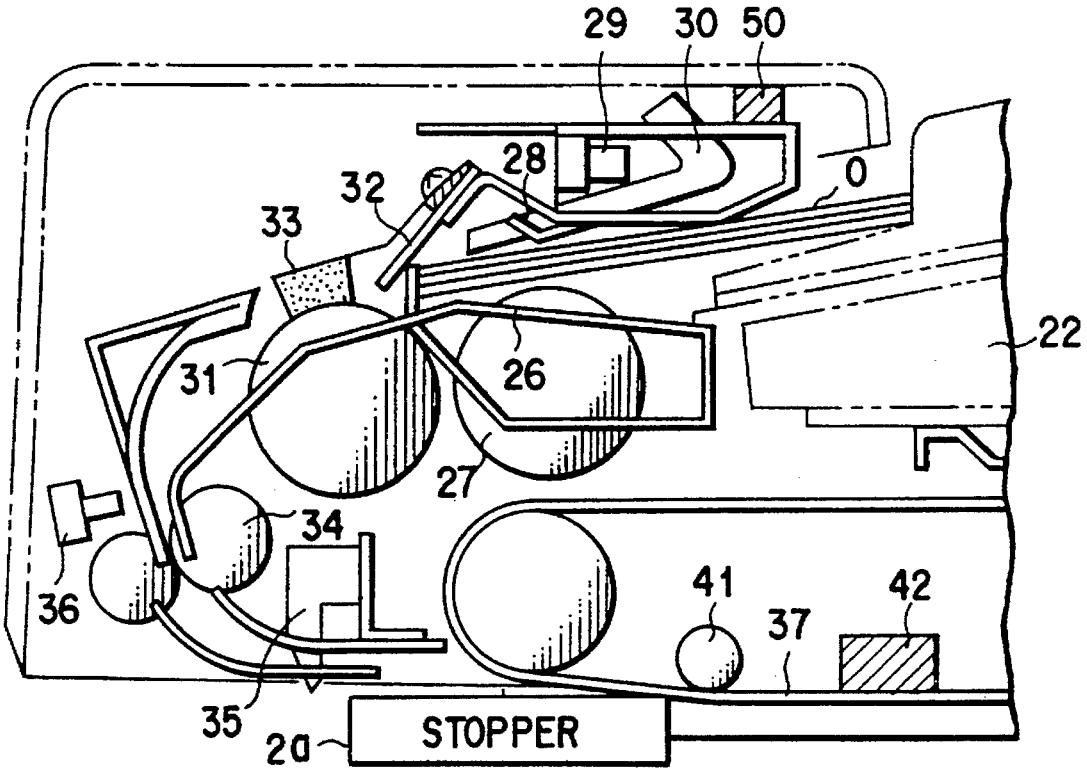
FIG. 2 is a sectional view for explaining an original conveying operation.

As shown in FIG. 2, a plurality of originals O are set (placed) on original feeding table 22 en bloc to abut against shutter 26. When originals O are set in this manner, actuator 30 pivots to turn on empty sensor 29. Meanwhile, necessary information is input through operation panel 52 (to be described later). Thereafter, copy key 52*c* is depressed. With this operation, shutter solenoid 68 and weight board solenoid 70 are turned on so that weight board 28 restrains originals O from floating, and shutter 26 retreats from paper feeding path 25. In addition, pickup roller 27 and feeding roller 31 are rotated to pick up the first one of originals O on original feeding table 22 which is located at the lowermost position and feed it to the lower surface side of original convey belt 37, which is traveling in the feeding direction, via the resist roller pair constituted by aligning rollers 34 (see FIGS. 3 and 4).

Original O is fed onto original table 2. Thereafter, in order to cause original O to abut against stopper 2*a*, original convey belt 37 is driven for a period of time corresponding to a predetermined pulse count after the trailing end of original O is detected by resist sensor 36. Original convey belt 37 is then driven in the reverse direction for a period of time corresponding to a predetermined pulse count so as to return original O. With this operation, setting of original O is completed (see FIGS. 5 and 6).

When setting of original O is completed, an original scanning operation is performed by original scanner unit 3 in copying machine body 1. Upon this operation, image forming unit 4 starts a copying operation with respect to a paper sheet as a transfer sheet.

After the copying operation is completed, original O is conveyed from original table 2 to be discharged onto discharged paper receiving portion 39 via paper discharge means 38 upon traveling of original convey belt 37.

When original O is conveyed from original table 2, next original O is fed onto original table 2. This operation is repeated until all originals O are fed from original feeding table 22.

A control circuit will be described next with reference to the block diagram of FIG. 7.

The control circuit includes main control unit 51 for controlling overall copying machine 1. Operation panel 52, original scanner unit 3, image forming unit 4, and interface 53 are connected to main control unit 51. Operation panel 52 is used to designate various operations. Interface 53 serves to exchange data with automatic document feeder 20.

Operation panel 52 is constituted by display unit **52*a* for guiding/displaying the contents of operations and the like, set keys 52*b* for performing various settings, copy key 52*c* for starting a copying operation, input mode switching key 52*d*, clear key 52*e***, and the like.

Automatic document feeder 20 has controller 61 for controlling overall automatic document feeder 20. The following components are connected to controller 61: driver 63 for feeding motor 62 as a drive source for pickup roller 27 and feeding roller 31; driver 65 for driving carrier motor 64 as a drive source for aligning rollers 34, original convey belt 37, convey roller 44, and paper discharge roller 48; empty sensor 29; original size sensor 35; resist sensor 36; SET switch 42; paper discharge sensor 46; cover switch 50; driver 67 for driving electromagnetic clutch 66 for transmitting/disconnecting the rotational force of carrier motor 64 to/from aligning rollers 34; driver 69 for driving shutter solenoid 68 for pivoting shutter 26; driver 71 for driving weight board solenoid 70 for pivoting weight board 28; memory 72 for storing various data; and interface 60 for exchanging data between copying machine 1 and ADC 74 for converting a voltage value from detector 73 into a digital value.

ADC 74 has an inversion/output function. ADC 74 outputs a digital value, corresponding to a change in voltage value from detector 73, to controller 61. Detector 73 is designed to detect a voltage value obtained by a change in resistance value of pressure sensitive conductive rubber **33*a* of separation pad 33. The digital value output from ADC 74 increases in the positive direction as the voltage value from detector 73** decreases.

Controller 61 determines a conveyed state, e.g., multiple paper-conveying (typically double paper-conveying) of originals O, on the basis of the digital value supplied from ADC 74. For example, when a digital value corresponding to voltage value V0 from detector 73 is supplied from ADC 74, controller 61 determines that no original O is conveyed. When a digital value corresponding to voltage value V1 from detector 73 is supplied from ADC 74, controller 61 determines that original O is properly conveyed. When a digital value corresponding to voltage value V2 from detector 73 is supplied from ADC 74, controller 61 determines multiple paper-conveying of originals O.

Figure 8:
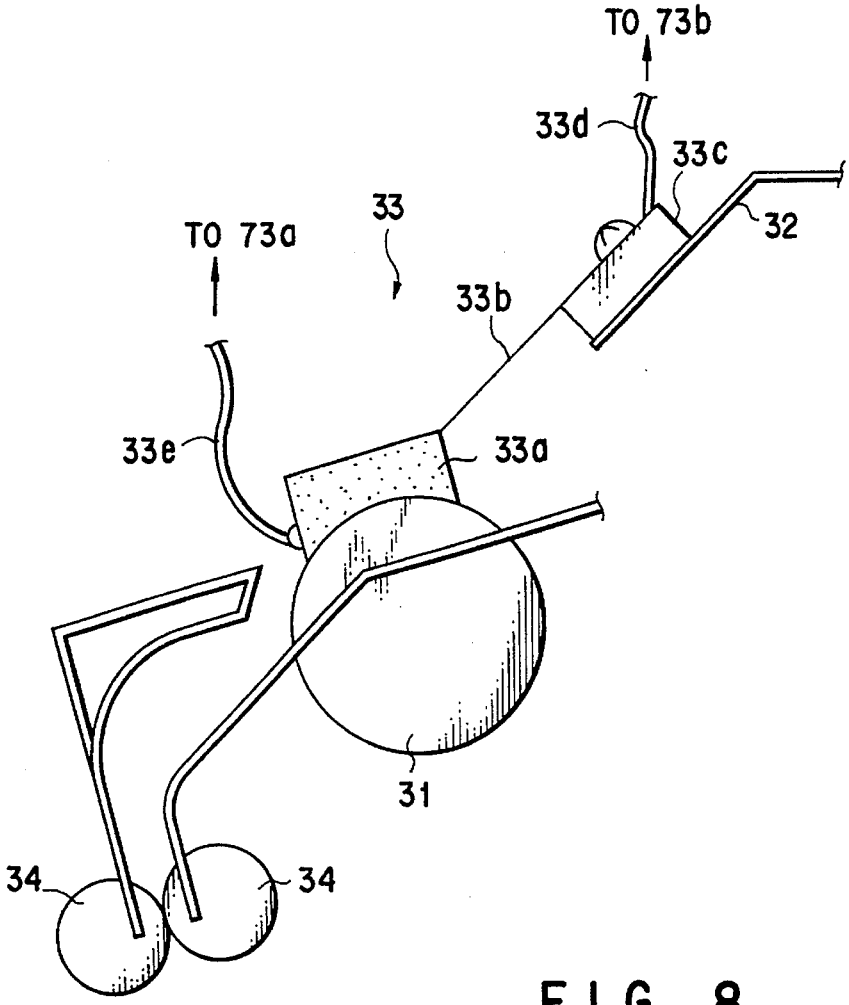
FIG. 8 is a view for explaining a separation pad and a feeding roller.
Figure 9:
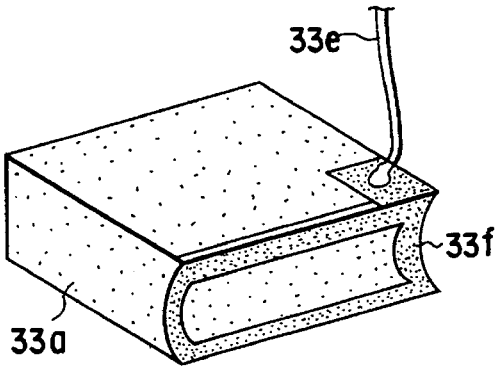
FIG. 9 is a view for explaining the main part of a separation pad.

As shown in FIGS. 8 and 9, separation pad 33 has pressure sensitive conductive rubber **33*a*. Pressure sensitive conductive rubber 33*a* is mounted on separation pad 33 so as to be urged against original table 2 by support plate 33*b*. Support plate 33*b* is fixed to frame 32 of automatic document feeder 20 via insulating member 33*c* with a plastic screw. Harness 33*d* for transmitting a signal from pressure sensitive conductive rubber 33*a* to detector 73 is connected to support plate 33*b***.

Support plate **33*b* may be connected to pressure sensitive conductive rubber 33*a* with a conductive adhesive. If, however, support plate 33*b* is insert-molded with pressure sensitive conductive rubber 33*a*, higher productivity and high mechanical strength can be ensured. If support plate 33*b* is made of a spring material such as SUS or phosphor bronze, support plate 33*b*** can serve as both an electrode and a pressing support member.

As shown in FIG. 9, another electrode **33*f* for extracting a signal is formed on a portion of the surface of separation pad 33, which is in contact with feeding roller 31**, by a thick-film printing method using a conductive ink. In general, a conductive ink layer has a thickness of 10 to 15 μm. Therefore, the gap between the conductive ink layer and the rubber portion serving as a separation portion is small, and there is no influence on the separation function. This value is sufficiently small as compared with the thickness of original O. That is, the thickness of a PPC sheet, which is widely used, is 80 to 150 μm, and the thickness of a drawing paper sheet or a tracing paper sheet is 50 to 70 μm.

Figure 10:
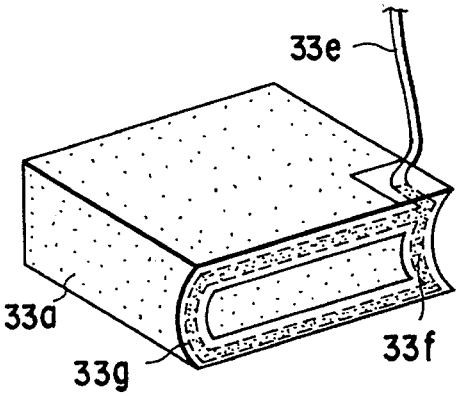
FIG. 10 is a view for explaining the main part of a separation pad.

Alternatively, as shown in FIG. 10, this portion may be constituted by flexible substrate **33*h* having pattern 33*g* formed thereon. In this case, the thickness of electrode 33*f* is 20 to 30 μm. This electrode 33*f* can be easily soldered to signal extraction harness 33*e* by forming a land on flexible substrate 33*h***.

A signal from pressure sensitive conductive rubber **33*a* is output to input terminal 73*a* of detector 73 via electrode 33*f* and harness 33*e*, and is also output to input terminal 73*b* of detector 73 via support plate 33*b* and harness 33*d***.

When, for example, original O is not sandwiched between separation pad 33 and feeding roller 31, pressure P0 is applied to separation pad 33, and voltage V0 is output from detector 73. When one original O is sandwiched between separation pad 33 and feeding roller 31, pressure P1 is applied to separation pad 33, voltage V1 is output from detector 73. When two originals O are sandwiched between separation pad 33 and feeding roller 31 (multiple paper-conveying of originals O), pressure P2 is applied to separation pad 33, and voltage V2 is output from detector 73 (P2>P1>P0; V0>V1>V2).

Figure 11:
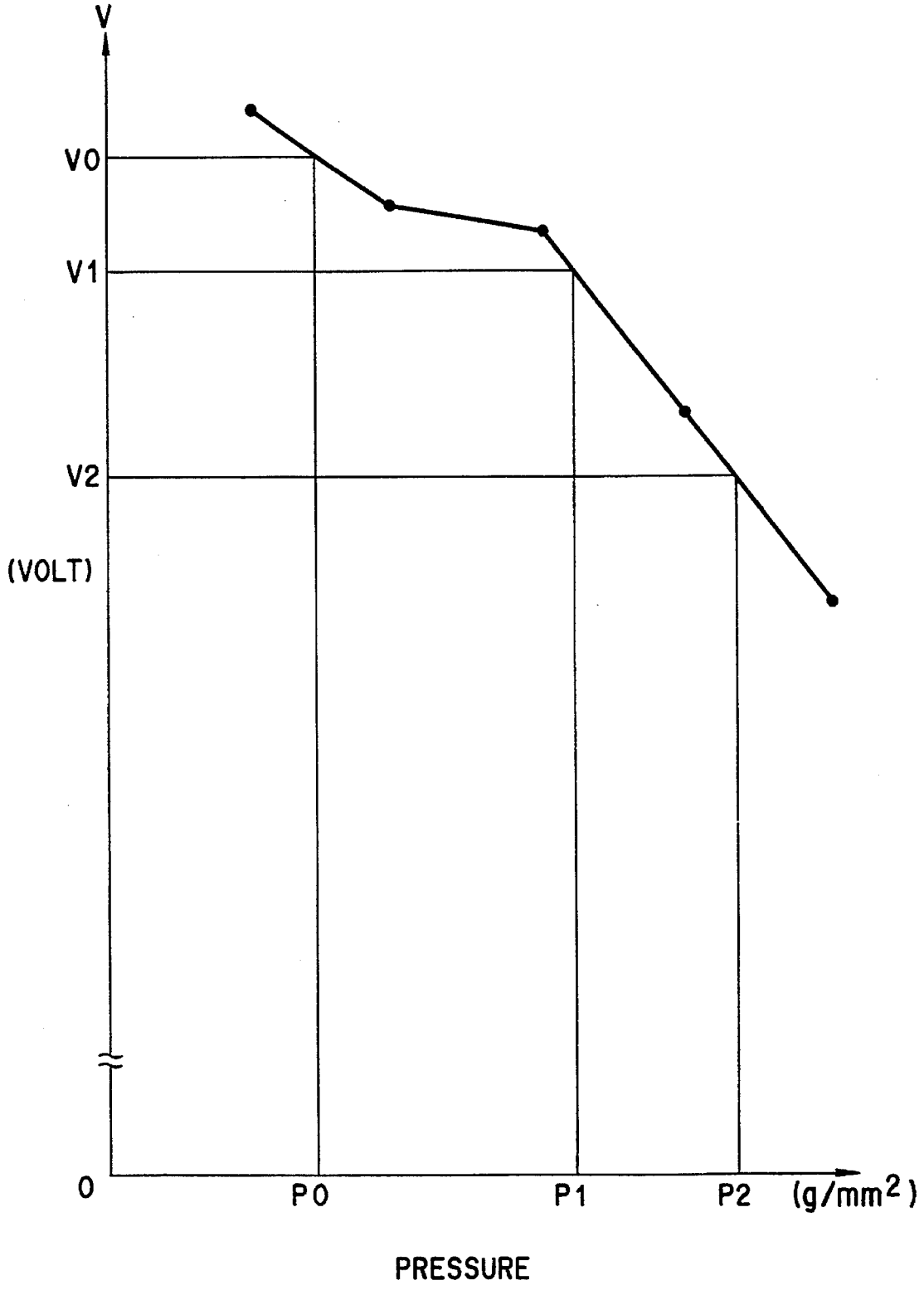
FIG. 11 is a graph showing a typical relationship between the pressure and resistance value of a pressure sensitive conductive rubber.

FIG. 11 shows the relationship between the pressure to separation pad 33 and the output voltage from detector 73.

Pressure sensitive conductive rubber **33*a* is made of a conductive elastomer (an elastic polymer such as silicone rubber) obtained by dispersing a conductive filler into a polymeric material to impart conductivity to the material. Pressure sensitive conductive rubber 33*a*** is a kind of elastomer which can extract a change in resistance value as a response to a pressure. This elastomer is also called a pressure sensitive conductive rubber (PCR).

Figure 12:
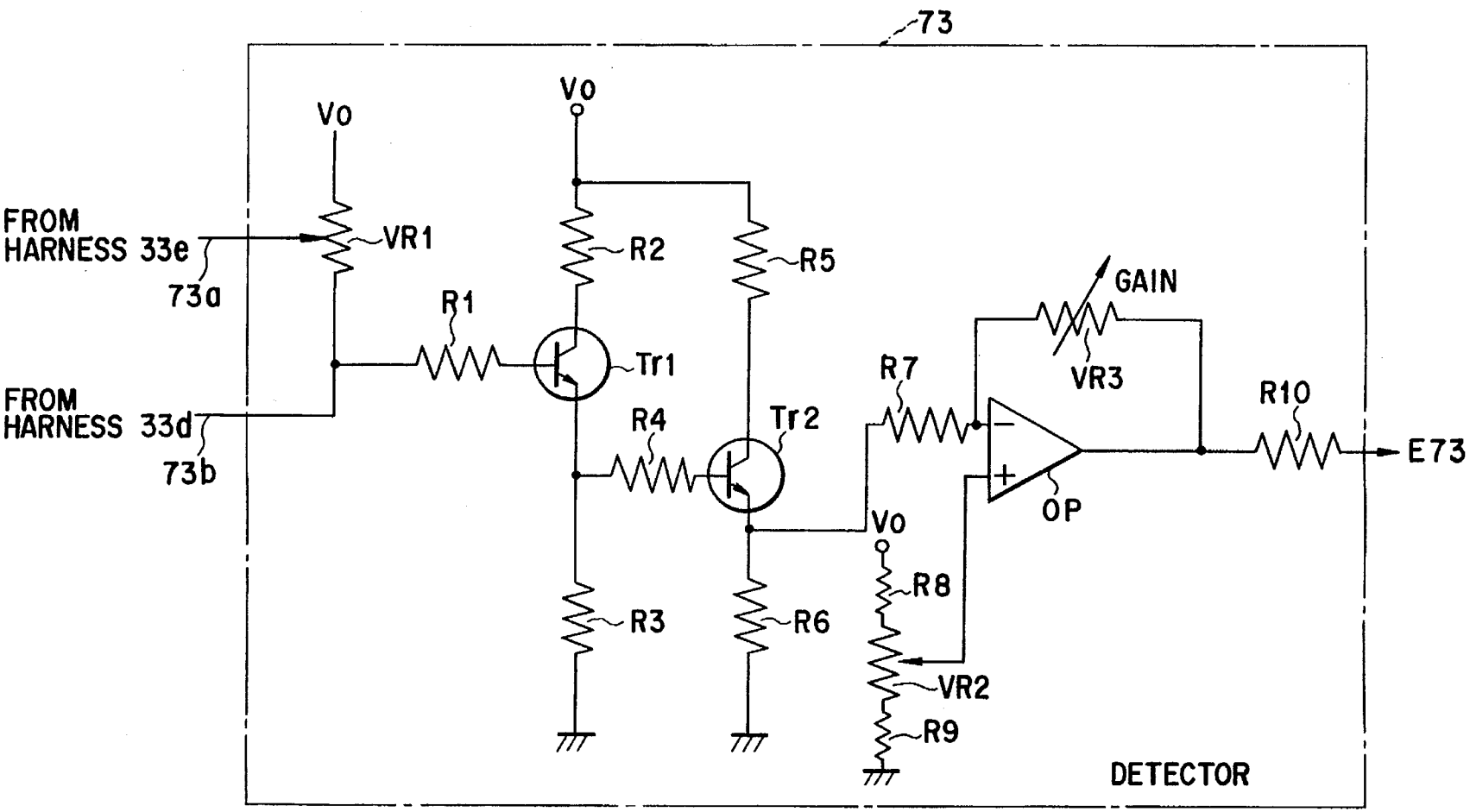
FIG. 12 is a circuit diagram showing the schematic arrangement of a detector.

As shown in FIG. 12, detector 73 is constituted by resistors R1 to R10, variable resistors VR1, VR2, and VR3, current detection type transistors Tr1 and Tr2, and operational amplifier OP. A resistance change from pressure sensitive conductive rubber 33*a* is supplied to input terminals 73*a* and 73*b* of detector 73. A current corresponding to this supplied resistance change is adjusted by variable resistor VR1 and resistor R1 to become the base current of transistor Tr1. Since the amplitude of the above-mentioned supplied resistance change is unknown, variable resistor (volume resistor) VR1 is used instead of a fixed resistor. The base current of transistor Tr1 is detected on the basis of the current detection ratio of transistor Tr1, and the emitter current of transistor Tr1 is shunted by resistors R4 and R5. The current flowing through resistor R4 is detected by transistor Tr2 on the basis of its current detection ratio. The emitter current of transistor Tr2 is shunted by resistors R6 and R7. The current flowing through resistor R7 is detected, as a current multiplied by a value of VR3/VR7 determined by variable resistor VR3 and resistor R7, by operational amplifier OP on the basis of a reference voltage. The reference voltage input to the non-inverting input terminal of operational amplifier OP is for input offset adjustment and adjusted by variable resistor VR2. A signal (voltage value) detected by operational amplifier OP is output to ADC 74 via resistor R10.

In the above case, the current detection ratio is increased by using two transistors Tr1 and Tr2. However, the present invention is not limited to this. For example, only one transistor Tr1 may be used. In this case, detector 73 outputs a signal from transistor Tr1 via resistor R4.

Furthermore, another resistor needs to be inserted between input terminal 73*b* and resistor R1 depending on a signal supplied to input terminal 73*b*.

An operation in the above-described arrangement will be described next with reference to FIGS. 2 to 6.

As shown in FIG. 2, a plurality of originals O are set (placed) on original feeding table 22 en bloc to abut against shutter 26. When originals O are set in this manner, actuator 30 is pivoted to turn on empty sensor 29. Meanwhile, necessary information is input through operation panel 52. Thereafter, copy key 52*c* is depressed. With this operation, controller 61 turns on shutter solenoid 68 and weight board solenoid 70. As a result, weight board 28 restrains originals O from floating, and shutter 26 retreats from paper feeding path 25.

Controller 61 also transmits the rotational force of feeding motor 62 to pickup roller 27 to rotate it. With this operation, original O is picked up from original feeding table 22 and fed between separation pad 33 and feeding roller 31. At this time, feeding roller 31 is at rest. Upon reception of an operation start instruction from main control unit 51, controller 61 outputs the instruction via timing generator 101, and transmits the rotational force of feeding motor 62 to feeding roller 31 to rotate it. With this operation, the first one of originals O on original feeding table 22 which is located at the lowermost position is fed by separation pad 33 and feeding roller 31, and is further fed to the lower surface side of original convey belt 37, which is traveling in the feeding direction, via the resist roller pair constituted by aligning rollers 34 (see FIGS. 3 to 5).

If a digital value from ADC 74 corresponds to voltage value V0 from detector 73 when a predetermined period of time has elapsed since feeding roller 31 was rotated, controller 61 determines that no original O is conveyed, thus determining a jam. If the digital value from ADC 74 corresponds to voltage value V2 from detector 73, controller 61 determines multiple paper-conveying of originals O.

Upon determining the jam, controller 61 stops feeding motor 62 and carrier motor 64, and outputs information indicating the occurrence of the jam to main control unit 51 of copying machine body 1 via interfaces 60 and 53. Main control unit 51 informs the occurrence of the jam through operation panel 52.

Upon determining the multiple paper-conveying error, controller 61 stops feeding motor 62 and carrier motor 64, and outputs information indicating the occurrence of the multiple paper-conveying error to main control unit 51 of copying machine body 1 via interfaces 60 and 53. Main control unit 51 informs the occurrence of the multiple paper-conveying error through operation panel 52.

Figure 13A:
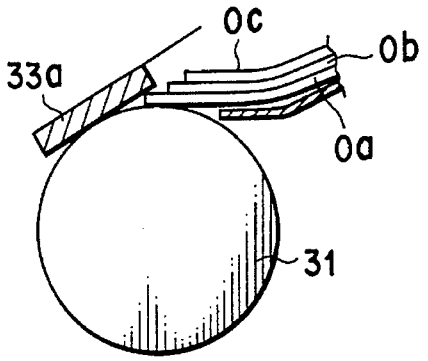
FIGS. 13A to 13C are sectional views for explaining how originals are separated and fed.

When pickup roller 27 is rotated, original O is fed between separation pad 33 and feeding roller 31, as shown in FIG. 13A. At this time, feeding roller 31 is at rest.

Figure 13B:
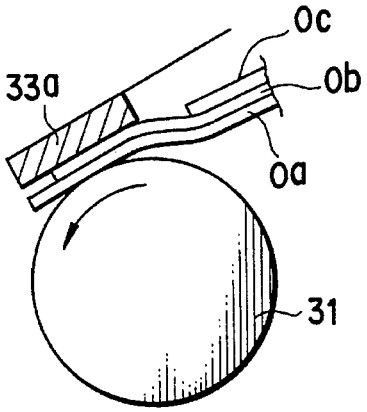
Figure 13C:
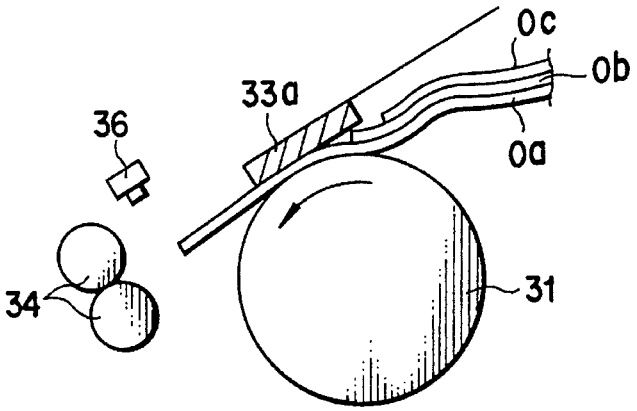
Figure 14A:
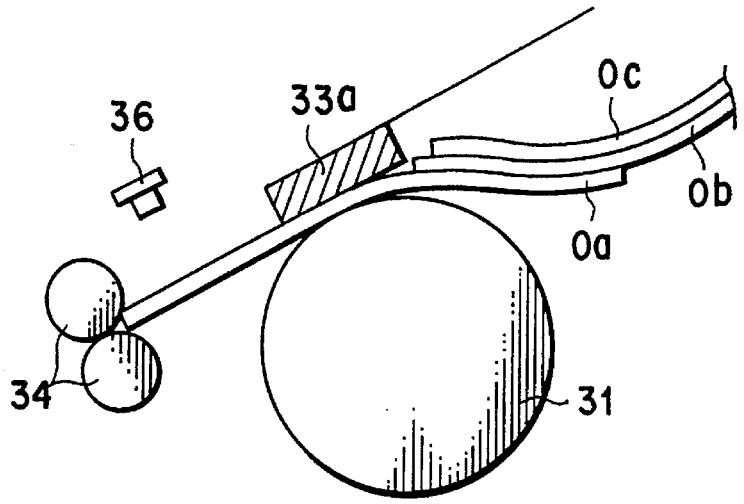
FIGS. 14A and 14B are sectional views for explaining how originals are separated and fed.
Figure 14B:
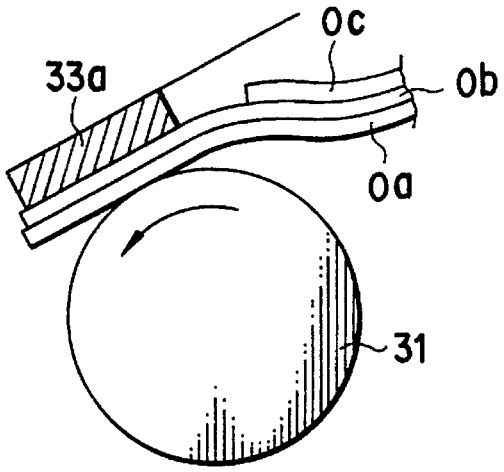

When rotation of feeding roller 31 is started, only one original O is fed by feeding roller 31 over time owing to the relationship between the frictional coefficients between feeding roller 31 and original O, between originals O, and between separation pad 33 and original O. FIGS. 13B, 13C, and 14A show this operation. Therefore, detection of a multiple paper-conveying error may be performed by detecting the thickness of original O after an elapse of a predetermined period of time since the start of rotation of feeding roller 31. If a multiple paper-conveying error occurs after this period, as shown in FIG. 14B, a change in pressure due to a change in thickness of original O can be detected.

When original O is properly fed onto original table 2, original convey belt 37 is driven to travel for a period of time corresponding to a predetermined pulse count to cause original O to abut against stopper 2*a* after the trailing end of original O is detected by original size sensor 35. Thereafter, original convey belt 37 is driven to travel in the reverse direction for a period of time corresponding to a predetermined pulse count. With this operation, setting of original O is completed.

When setting of original O is completed, original scanner unit 3 in copying machine body 1 scans original O. Image forming unit 4 then starts a copying operation with respect to a paper sheet as a transfer sheet.

After the original scanning operation of original scanner unit 3 is completed, original O is conveyed from original table 2 upon traveling of original convey belt 37, and is discharged onto discharged paper receiving portion 39 via paper discharge means 38.

When paper discharge path 43 is pivoted by the leading end of original O to turn on paper discharge means 38, controller 61 stops original convey belt 37. In addition, controller 61 stops convey roller 44 and paper discharge roller 48 when a predetermined period of time (several 10 msec) has elapsed since paper discharge means 38 was turned off by the trailing end of original O.

When original O is conveyed from original table 2, next original O is fed onto original table 2. This operation is repeated until all originals O are fed from original feeding table 22.

Another embodiment will be described next, which includes a thickness detector for detecting the thickness of original O on the basis of output signal (voltage value) E74 from ADC 74 in FIG. 7, and determines multiple paper-conveying of originals O as a conveyed state on the basis of the detection result obtained by the thickness detector. In this case, the control circuit has thickness detector 100 between ADC 74 and controller 61 in FIG. 7.

Thickness detector 100 detects the thickness of fed original O in accordance with digital value E74, from ADC 74, which corresponds to voltage value E73 obtained by a change in resistance value of separation pad 33 and supplied from detector 73. Thickness detector 100 outputs detection signal E100 indicating whether the thickness of each of second and subsequent originals O is larger than the thickness, of first original O, which is set as a reference value, or outputs a signal indicating whether the thickness of first original O is larger than that of second original O. These detection signals E100 are output to controller 61.

Controller 61 serves to determine a conveying error of original O on the basis of a detection signal from thickness detector 100. If, for example, a detection signal indicating that the thickness of second or subsequent original O is larger than a reference value is supplied from thickness detector 100, controller 61 determines a multiple paper-conveying error of second or subsequent original O. If a detection signal indicating that the thickness of first original O is larger than that of second original O is supplied from thickness detector 100, controller 61 determines a multiple paper-conveying error of first original O.

Figure 15:
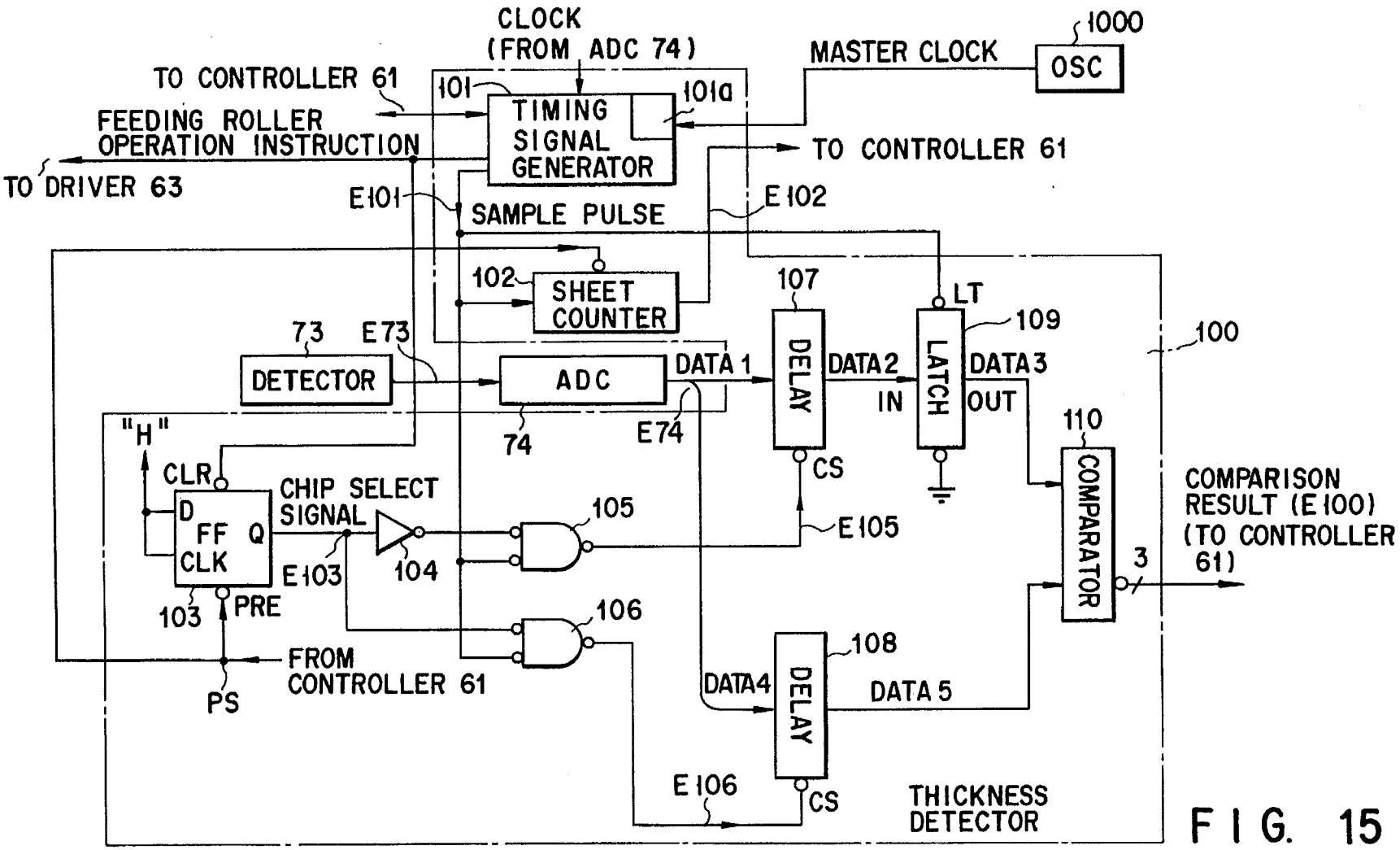
FIG. 15 is a block diagram showing the schematic arrangement of a thickness detector.

As shown in FIG. 15, thickness detector 100 is constituted by timing generator 101, sheet counter 102, FF circuit 103, inverter 104, AND gates 105 and 106, delay CKTs 107 and 108, latch 109, and comparator 110.

Timing generator 101 generates various timing signals in accordance with various instructions supplied from controller 61. In accordance with an operation instruction with respect to feeding roller 31 for feeding originals O one by one, timing generator 101 outputs a feeding roller operation instruction like the one shown in FIG. 16A to driver 63.

Figures 16A, 16B, 16C, 16D:
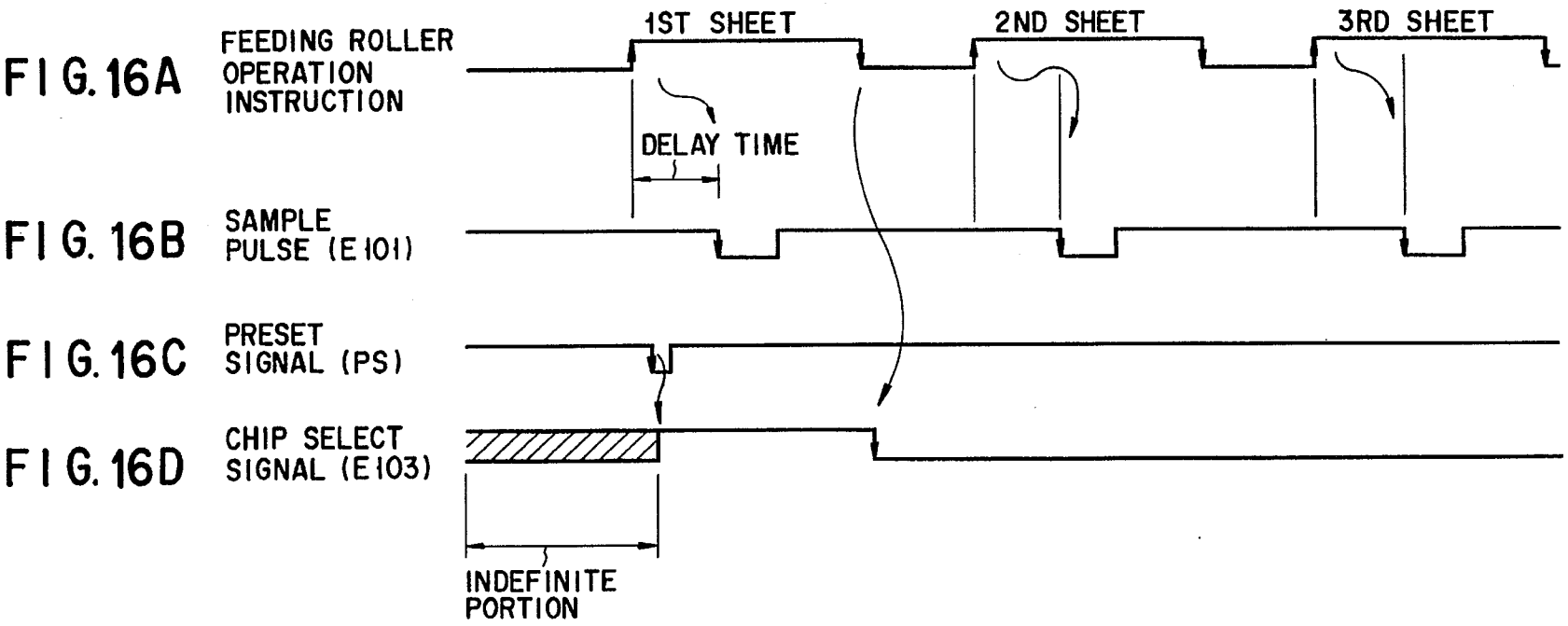
FIGS. 16A to 16D are timing charts for explaining the operation of the main part of the thickness detector.

Timing generator 101 outputs sampling pulse E101 like the one shown in FIG. 16A when a predetermined period of time has elapsed since the feeding roller operation instruction was output. This sampling pulse is output to sheet counter 102, AND gates 105 and 106, and latch 109.

Timing generator 101 incorporates counter 101*a* for counting master clocks from oscillator 1000. Counter 101*a* starts a count-up operation from "0" at the leading edge of the feeding roller operation instruction.

When the count value of counter 101*a* reaches a predetermined count, timing generator 101 outputs sampling pulse E101 shown in FIG. 16B. This output E101 is output only once when the feeding roller operation instruction is set at "H" level, as shown in FIGS. 16B to 16D.

Sheet counter 102 counts the number of fed originals O on the basis of sampling pulses E101 from timing generator 101, and outputs count result E102 to controller 61.

FF circuit 103 is a D-flip-flop. Data input terminal D and clock input terminal CLK of FF circuit 103 are held at "H" level, and a pulse corresponding to the feeding roller operation instruction from timing generator 101 is supplied to clear input terminal CLR. In addition, preset signal ("L" level) PS like the one shown in FIG. 16C is supplied from controller 61 to preset input terminal PRE. Preset input terminal PRE is normally held at "H" level.

With this operation, as shown in FIG. 16D, after chip select signal (Q output) E103 from FF circuit 103 is set at "H" level by preset signal PS from controller 61, and the pulse corresponding to the first feeding roller operation instruction is set at "L" level, chip select signal E103 is kept at "L" level. That is, when first original O passes between separation pad 33 and feeding roller 31, chip select signal E103 changes from "H" level to "L" level, and is kept at "L" level afterward.

Chip select signal E103 from FF circuit 103 is supplied as signal E105 to the chip select terminal CS of delay CKT 107, via inverter 104 and AND gate 105. This signal E103 is also supplied as signal E106 to the chip select terminal CS of delay CKT 108, via AND gate 106.

AND gates 105 and 106 are enabled by sampling pulse E101 from timing generator 101, and chip select signal E103 from FF circuit 103 is output to each chip select terminal CS of delay CKTs 107 and 108.

Each of delay CKTs 107 and 108 has a latch function of temporarily storing digital value E74 from ADC 74 and outputs the stored digital value with a delay of a predetermined period of time. The output (DATA 2) from delay CKT 107 is supplied to latch 109. The output (DATA 5) from delay CKT 108 is supplied to comparator 110. With the use of delay CKT 108, even if the conveying timing of second and subsequent originals O is shifted from that of first original O, thickness detection can be performed.

Latch 109 latches the digital value (DATA 2) from delay CKT 107 in response to sampling pulse E101 from timing generator 101. With this operation, data indicating the thickness at a predetermined position of first original O is latched. The content (DATA 3) latched by latch 109 is supplied to comparator 110.

While first original O is sandwiched between separation pad 33 and feeding roller 31, the output of inverter 104 is at "L" level. For this reason, when sampling clock E101 is at "L" level, terminal CS of delay CKT 107 is set at "L" level, and delay CKT 107 is set in an enabled state.

Delay CKT 107 is set in an enabled state only when both the signal outputs (the output of inverter 104 and pulse E101) are set at "L" level.

Therefore, the data indicating the thickness of first original O is converted into digital data E74 by ADC 74, and is temporarily stored, as DATA 1, in delay CKT 107.

DATA 1 temporarily stored in delay CKT 107 is output, as DATA 2, to latch 109. Sampling pulse E101 is input to terminal LT of latch 109.

At the leading edge of sampling pulse E101, latch 109 latches DATA 2.

Meanwhile, chip select signal E103 and sampling pulse E101 are input to AND gate 106.

An output from AND gate 106 is input to terminal CS of delay CKT 108.

Delay CKT 108 is set in an enabled state only when both the signal outputs are set at "L" level.

While first original O is sandwiched between separation pad 33 and feeding roller 31, since chip select signal E103 is at "H" level, delay CKT 108 is in a disabled state.

When separation processing of first original O is completed, chip select signal E103 is set at "L" level. Therefore, the output of inverter 104 is set at "H" level, and output E105 of AND gate 105 is set at "H" level. Consequently, delay CKT 107 is kept in a disabled state.

Meanwhile, if chip select signal E103 is set at "L" level, and when sampling pulse E101 becomes "L" level, terminal CS (or output E106 of AND gate 106) of delay CKT 108 is set at "L" level. As a result, delay CKT 108 is set in an enabled state.

Therefore, while separation processing of second or subsequent original O is performed, a signal indicating the thickness of second or subsequent original O, or DATA 4 indicating the thickness of second or subsequent original O, is input/stored to/in delay CKT 108. DATA 3 stored in latch 109 and DATA 5 stored in delay CKT 108 are supplied to comparator 110.

Comparator 110 incorporates a subtracter, and serves to compare data in a predetermined range, which is based on thickness data (DATA 3) associated with first original O and supplied from latch 109, with thickness data (DATA 5) associated with second or subsequent original O and supplied from delay CKT 108. With this comparison, comparator 110 outputs a signal (E100) indicating that the thickness of second or subsequent original O is equal to that of first original O, a signal (E100) indicating that the thickness of second or subsequent original O is larger than that of first original O, or a signal (E100) indicating that the thickness of first original O is larger than that of second or subsequent original O, to controller 61.

For example, comparator 110 outputs 3-bit comparison results CPR1, CPR2, and CPR3 (=E100). When the thickness of first original O is larger than that of second or subsequent original O, comparison result CPR1 is set at "L" level. When the thickness of second or subsequent original O is larger than that of first original O, comparison result CPR2 is set at "L" level. When the thickness of second or subsequent original O is equal to that of first original O, comparison result CPR3 is set at "L" level.

Comparator 110 and controller 61 may be connected through three signal lines or a tristate signal line.

Figure 17:
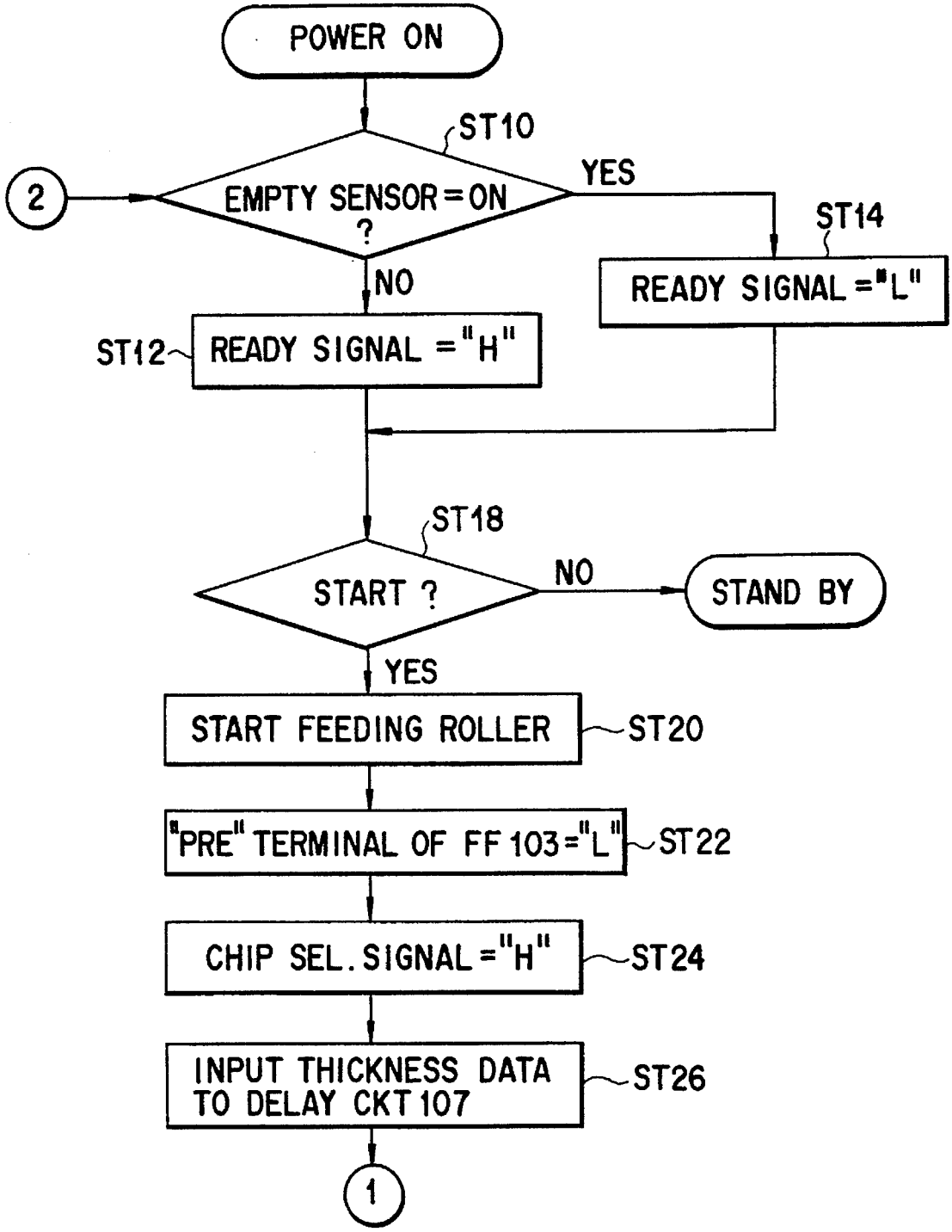
FIG. 17 is a flow chart for explaining a multiple paper-conveying error detecting operation to be performed while originals are separated and fed.

An operation in the arrangement shown in FIG. 15 will be described with reference to the flow charts of FIGS. 17 and 18.

Assume that a plurality of originals O are set (placed) on original feeding table 22 en bloc to abut against shutter 26. When originals O are set in this manner, actuator 30 is pivoted to turn on empty sensor 29 (YES in step ST10), and an "L"-level ready signal (not shown) is generated (step ST14). If no original O is present, empty sensor 29 is turned off (NO in step ST10), and an "H"-level ready signal is generated (step ST12).

Meanwhile, necessary information is input through operation panel 52. Thereafter, copy key 52*c* is depressed (YES in step ST18). With this operation, controller 61 turns on shutter solenoid 68 and weight board solenoid 70. As a result, weight board 28 restrains originals O from floating, and paper feeding path 25 retreats from shutter 26.

Controller 61 gives an instruction to transmit the rotational force of feeding motor 62 to pickup roller 27 and feeding roller 31, thus rotating them. With this operation, first original O located at the lowermost position on original feeding table 22 is picked up to be fed. Original O is then fed to the lower surface side of original convey belt 37, which is traveling in the feeding direction, via the resist roller pair constituted by aligning rollers 34.

When the leading edge of first original O reaches the position between separation pad 33 and feeding roller 31, controller 61 causes timing generator 101 to output a feeding roller operation instruction (step ST20). In response to the feeding roller operation command, feeding roller 31 is rotated. After the feeding roller operation instruction is output, controller 61 outputs a preset signal (PS="L") to preset terminal PRE of FF circuit 103 to set FF circuit 103 (step ST22). As a result, the chip select signal is set at "H" level (step ST24).

After an elapse of a predetermined period of time since the output of the feeding roller operation instruction, timing generator 101 outputs sampling pulses to sheet counter 102, AND gates 105 and 106, and latch 109. With this operation, sheet counter 102 is incremented, and AND gates 105 and 106 are enabled to supply a chip select signal to delay CKT 107. As a result, the thickness data associated with first original O and supplied from ADC 74 is stored, as a reference value, in delay CKT 107 (step ST26).

When first original O passes between separation pad 33 and feeding roller 31, the data corresponding to the thickness of first original O is stored, as a reference value, in latch 109 in thickness detector 100 (step ST28).

When the trailing edge of first original O has passed between separation pad 33 and feeding roller 31 (YES in step ST30), the feeding roller operation instruction from timing generator 101 is set at "L" level. As a result, FF circuit 103 is cleared, and the chip select signal is set at "L" level (step ST32).

When first original O is properly fed onto original table 2, original convey belt 37 is driven to travel for a period of time corresponding to a predetermined pulse count to cause first original O to abut against stopper 2*a* after the trailing end of original O is detected by original size sensor 35. Thereafter, original convey belt 37 is driven to travel in the reverse direction for a period of time corresponding to a predetermined pulse count. With this operation, setting of original O is completed.

When setting of first original O is completed, original scanner unit 3 in copying machine body 1 scans original O. Image forming unit 4 then starts a copying operation with respect to a paper sheet as a transfer sheet.

After the original scanning operation of original scanner unit 3 is completed, first original O is conveyed from original table 2 upon traveling of original convey belt 37, and is discharged onto discharged paper receiving portion 39 via paper discharge means 38.

When first original O is conveyed from original table 2, second original O is fed from original feeding table 22 onto original table 2 in the same manner as described above.

When second original O passes between separation pad 33 and feeding roller 31, data corresponding to the thickness of second original O is compared with the reference value corresponding to the thickness of first original O, and the comparison result is output to controller 61.

More specifically, when the leading end of second original O reaches the position between separation pad 33 and feeding roller 31, controller 61 causes timing generator 101 to output a feeding roller operation instruction. In response to the feeding roller operation instruction, feeding roller 31 is rotated.

After an elapse of a predetermined period of time since the output of the feeding roller operation instruction, timing generator 101 outputs a sampling pulse to sheet counter 102, AND gates 105 and 106, and latch 109. With this operation, sheet counter 102 is incremented, and AND gates 105 and 106 are enabled to supply a chip select signal to delay CKT 108. As a result, the thickness data associated with second original O and supplied from ADC 74 is stored in delay CKT 108 (step ST34).

Comparator 110 then compares data in a predetermined range, which is based on the thickness data associated with first original O and supplied from latch 109, with the thickness data associated with second original O and supplied from delay CKT 108 (step ST40). If the thickness of first original O is larger than that of second original O, comparison result CPR1 is set at "L" level. If the thickness of second original O is larger than that of first original O, comparison result CPR2 is set at "L" level. If the thickness of second original O is equal to that of first original O, comparison result CPR3 is set at "L" level.

When a detection signal indicating that the thickness of second original O is larger than that of first original O is supplied from thickness detector 100 ("Z" at step ST40), controller 61 determines multiple paper-conveying of second original O. When a detection signal indicating that the thickness of first original O is larger than that of second original O is supplied from thickness detector 100 ("Y" at step ST40), controller 61 determines multiple paper-conveying of first original O.

Upon detection of this multiple paper-conveying error, controller 61 stops the feeding operation (step ST42) and outputs information indicating the occurrence of the multiple paper-conveying error to main control unit 51 (step ST44). With this operation, main control unit 51 informs the occurrence of the multiple paper-conveying error through display unit 52*a* of operation panel 52. Then the process returns to step ST 10.

When a detection signal indicating that the thickness of second original O is equal to that of first original O is supplied from thickness detector 100 ("X" at step ST40), controller 61 performs an original scanning operation and paper discharge processing with respect to second original O. At the same time, third original O is fed from original feeding table 22 onto original table 2 in the same manner as described above.

While empty sensor 29 is ON (YES in step ST46), determination of a multiple paper-conveying error is performed with respect to third and subsequent originals O in the same manner as described above (steps ST34 to ST44).

In this case, when a multiple paper-conveying error is determined, the feeding operation is stopped, and the occurrence of the multiple paper-conveying error is informed through display unit 52*a*. However, the number of originals which have been processed before the occurrence of the multiple paper-conveying error may be informed through display unit 52*a*.

In addition, the preset signal from controller 61 has also been supplied to sheet counter 102. For this reason, at the time the feeding operation is restarted, sheet counter 102 is cleared to "0" if multiple paper-conveying of first original O is determined. If multiple paper-conveying of second or subsequent original O is determined, the count value of sheet counter 102 set immediately before the occurrence of the multiple paper-conveying error is held. With this operation, when the feeding operation is to be restarted, a user may set a document on original feeding table 22 from original O which has undergone multiple paper-conveying.

With this arrangement, when a multiple paper-conveying error occurs, the user need not perform a feeding operation from the first original, thus saving time.

If a preset signal ("L" level) from controller 61 is supplied to FF circuit 103 when a multiple paper-conveying error occurs while a plurality of originals O are fed, the reference thickness data in latch 109 is initialized. With this operation, thickness data associated with first original O fed after the multiple paper-conveying error is corrected is stored, as a reference value, in latch 109.

With this operation, a multiple paper-conveying error can be detected by setting thickness data associated with first original O as a reference value in units of documents set on original feeding table 22. In general, originals of one document (a set of originals O) have the same thickness. Therefore, by updating reference data in units of documents at the time no document is left on original feeding table 22, a multiple paper-conveying error can be detected even if documents having various thicknesses are set on automatic document feeder 20.

Figure 19:
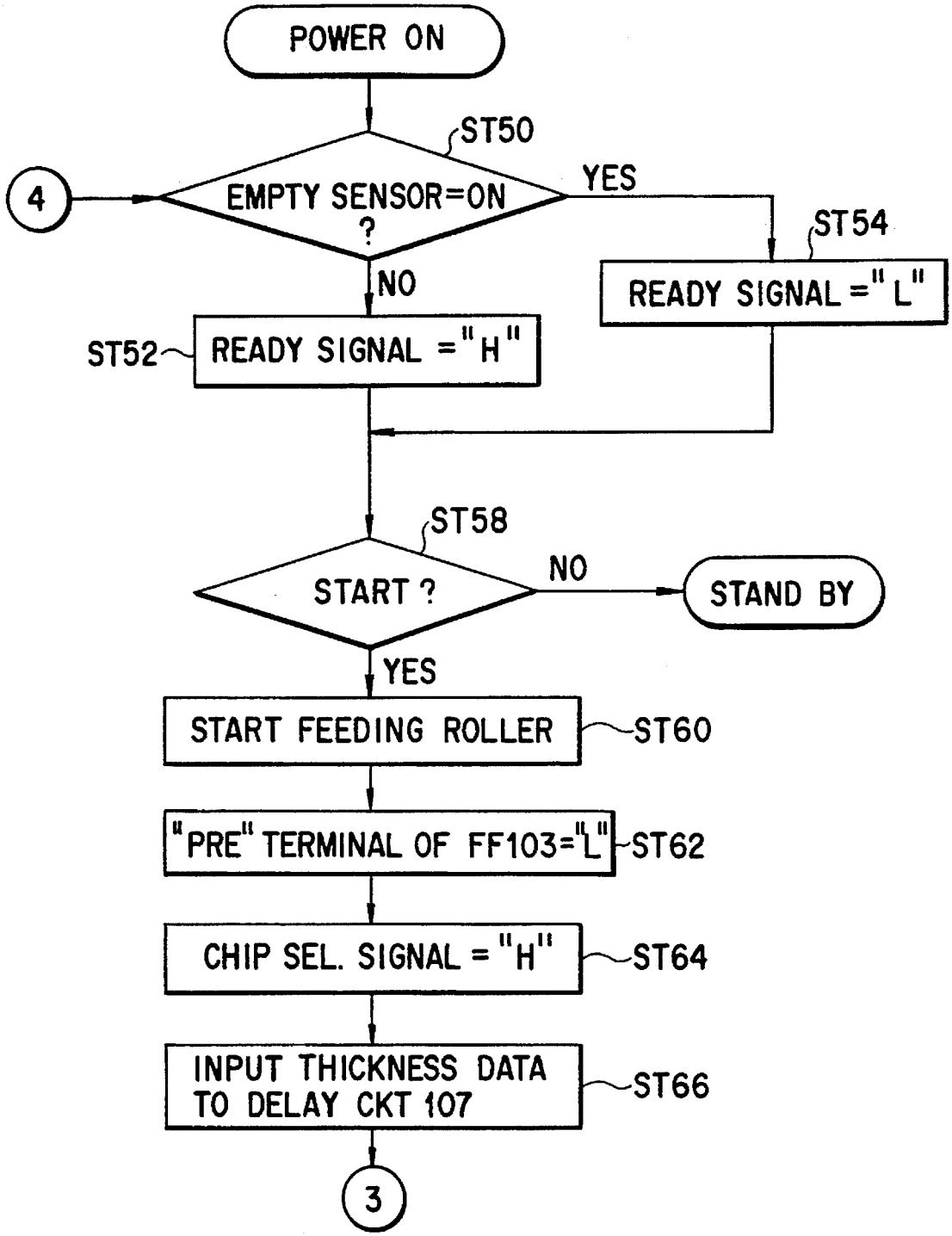
FIG. 19 is a flow chart for explaining a multiple paper-conveying error detecting operation to be performed while originals are separated and fed.
Figure 20:
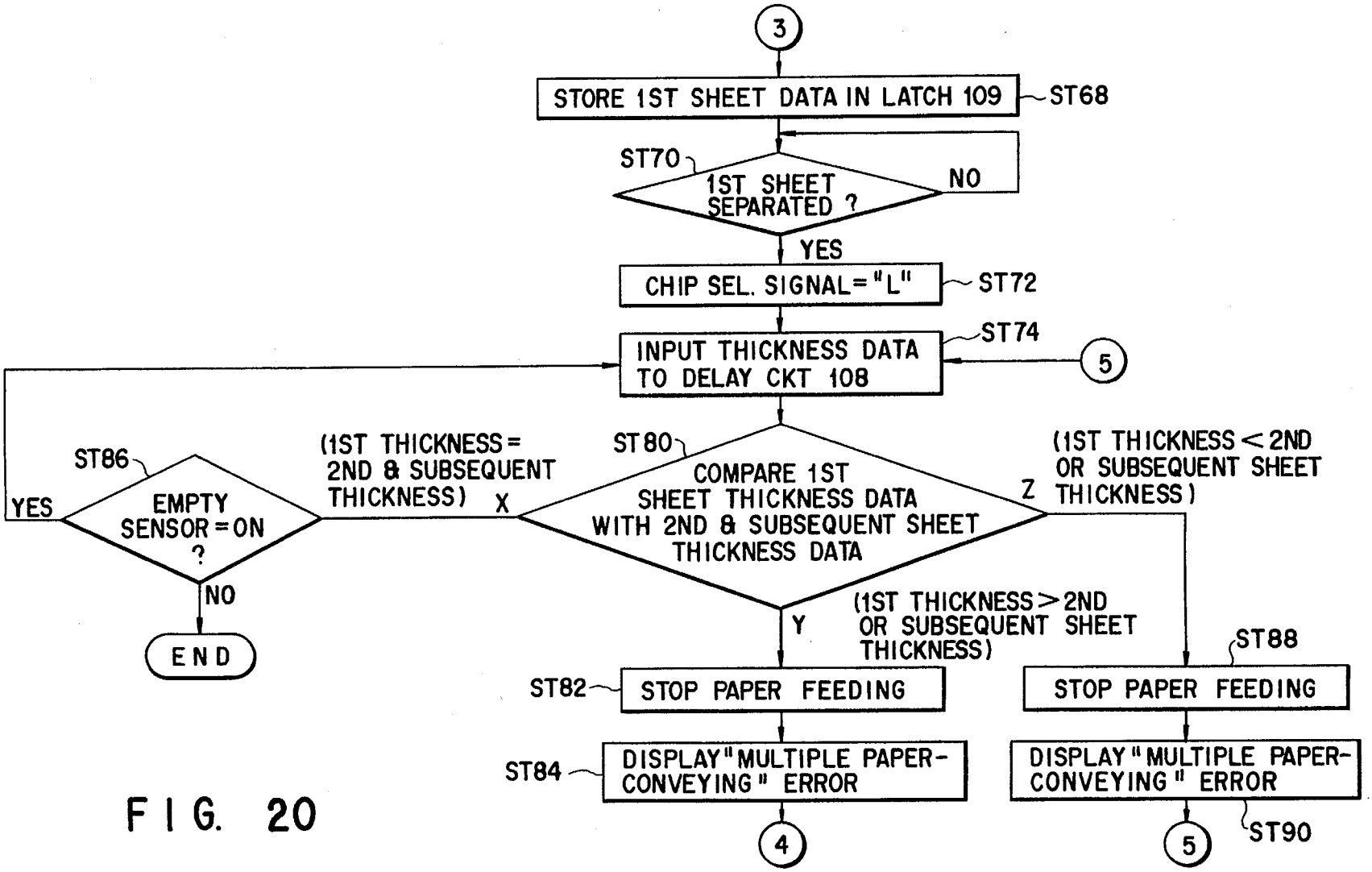
FIG. 20 is a flow chart for explaining a multiple paper-conveying error detecting operation to be performed while originals are separated and fed.

If preset signal PS from controller 61 is not supplied to FF circuit 103 when a multiple paper-conveying error occurs while a plurality of originals O are fed, thickness data associated with first original O fed before the occurrence of the multiple paper-conveying error is stored/held, as a reference value, in latch 109. FIGS. 19 and 20 are flow charts showing an operation in this case.

Figure 3:
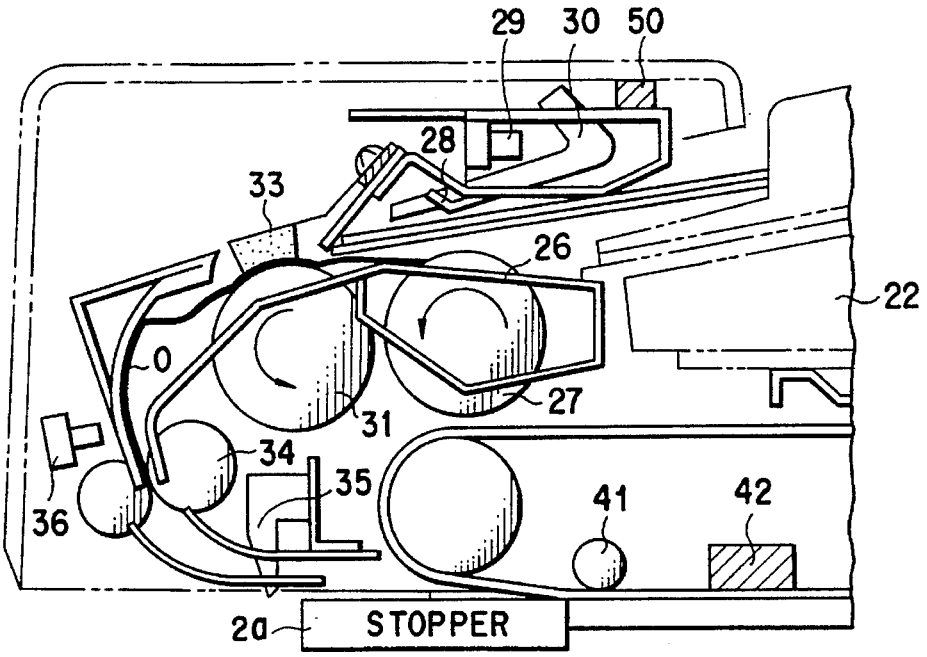
FIG. 3 is a sectional view for explaining an original conveying operation.

Assume that a plurality of originals O are set (placed) on original feeding table 22 in FIG. 3 en bloc to abut against shutter 26. When originals O are set in this manner, actuator 30 pivots to turn on empty sensor 29 (YES in step ST50). Empty sensor 29 then outputs an "L"-level ready signal (step ST54). If no original O is present (NO in step ST 50), empty sensor 29 is turned off to output an "H"-level ready signal (step ST52).

Subsequently, necessary information is input through operation panel 52, and copy key 52*c* is depressed (YES in step ST58). With this operation, controller 61 turns on shutter solenoid 68 and weight board solenoid 70. As a result, weight board 28 restrains originals O from floating, and shutter 26 retreats from paper feeding path 25.

Figure 7:
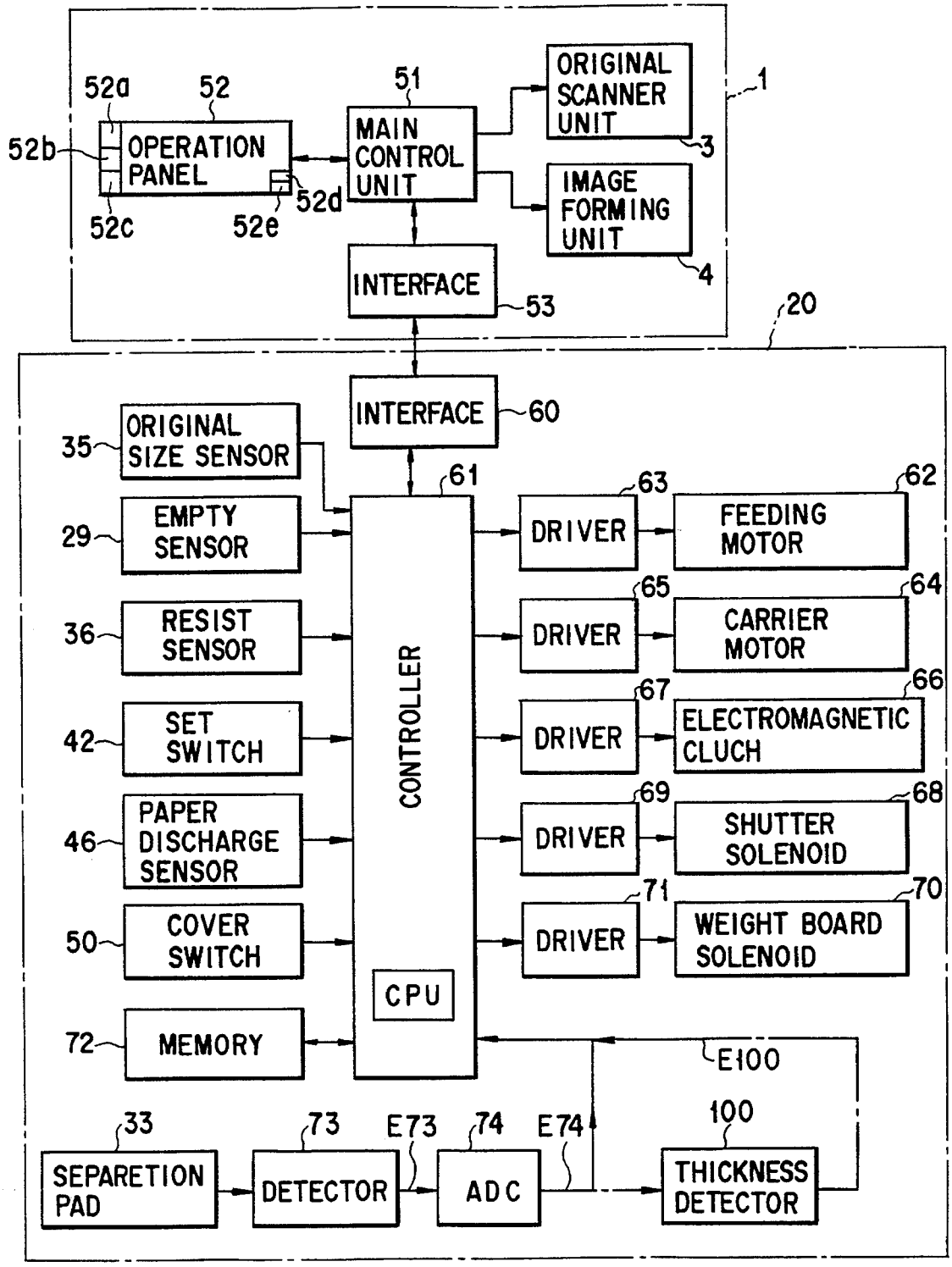
FIG. 7 is a block diagram showing the schematic arrangement of a control circuit of the image forming apparatus.

After this operation, the CPU of controller 61 in FIG. 7 starts feeding motor 62 (step ST60), and outputs "L"-level preset signal PS to the preset terminal of FF circuit 103 in FIG. 15 (step ST 62). As a result, "H"-level chip select signal E103 is output from FF circuit 103 (step ST64).

When "L"-level sampling pulse E101 is generated by timing signal generator 101, outputs E105 and E106 from gates 105 and 106 are respectively set at "L" level and "H" level in response to "H"-level chip select signal E103. As a result, delay circuit 107 is enabled, and delay circuit 108 is disabled. Thickness data (DATA 1) associated with first original O is input to enabled delay circuit 107 (step ST66).

Delay circuit 107 temporarily holds the input thickness data (DATA 1) associated with first original O, and stores the held thickness data (DATA 2) associated with first original O in latch 109 at the timing of next sampling pulse E101 (step ST68).

Figure 4:
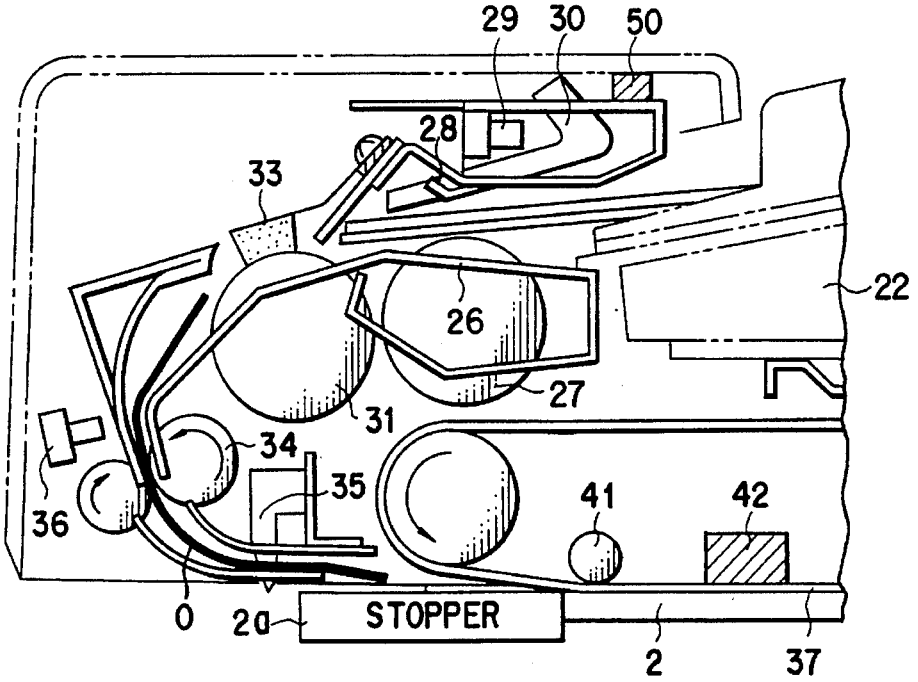
FIG. 4 is a sectional view for explaining an original conveying operation.
Figure 5:
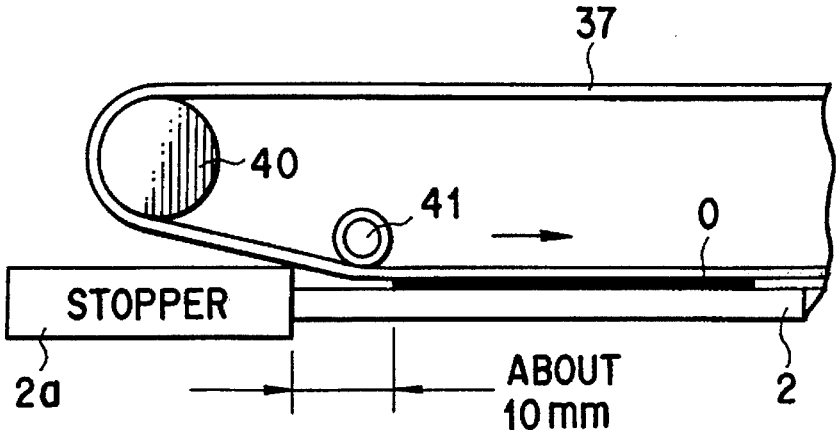
FIG. 5 is a sectional view for explaining an original conveying operation.
Figure 6:
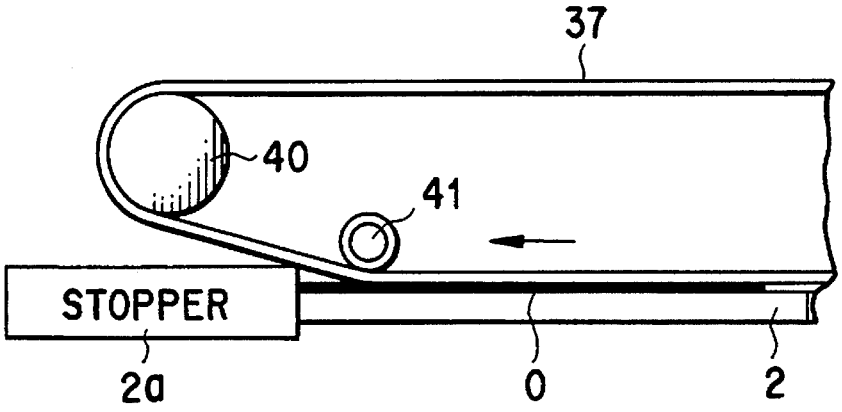
FIG. 6 is a sectional view for explaining an original conveying operation.

Subsequently, as shown in FIGS. 14A, 3 and 4, first original O is separated from the remaining originals by pressure sensitive conductive rubber 33*a* of separation pad 33 (YES in step ST70). When the trailing end of original O is detected by resist sensor 36, the CPU of controller 61 transmits "H"-level preset signal PS to the preset terminal of FF circuit 103. As a result, "L"-level chip select signal E103 is output from FF circuit 103 (step ST72).

When "L"-level sampling pulse E101 is generated by timing signal generator 101, outputs E105 and E106 from gates 105 and 106 are respectively set at "H" level and "L" level in response to "L"-level chip select signal E103. As a result, delay circuit 108 is enabled, and delay circuit 107 is disabled. Thickness data (DATA associated with second or subsequent original O is input to enabled delay circuit 108 (step ST74).

Delay circuit 108 temporarily holds the input thickness data (DATA 4) associated with second or subsequent original O, and outputs the held thickness data (DATA 5) associated with second or subsequent original O to comparator 110 at the timing f next sampling pulse E101. the thickness data (DATA 3) associated with first original O has been input, as reference data for comparison, from latch 109 to comparator 110.

Comparator 110 compares the thickness data (DATA 3) associated with first original O with thickness data (DATA 5) associated with second or subsequent original O (step ST40).

If DATA 3>DATA 5 (Y at step ST80), it is determined that first original O has undergone multiple paper-conveying.

Controller 61 then outputs "L"-level preset signal PS. The feeding operation is immediately stopped (step ST82), and information indicating the occurrence of the multiple paper-conveying error is displayed on the display unit (not shown) of the apparatus (step ST84). When original O which ash undergone multiple paper-conveying is properly set again (YES in step ST50), the feeding operation is restarted from step ST58.

If DATA 3<DATA 5 (z at step ST80), it is determined that second or subsequent original O has undergone multiple paper-conveying. In this case, the feeding operation is immediately stopped (step ST88), and information indicating the occurrence of the multiple paper-conveying error is displayed on the display unit of the apparatus (step ST90). When second or subsequent original O is released from the multiple paper-conveying condition and properly set again, the feeding operation is restarted from step ST74.

If DATA 3<DATA 5 (X at step ST80), it is determined that no multiple paper-conveying has occurred. In this case, if any original to be fed is still left, and empty sensor 29, is kept ON (YES in step ST86), the operation in steps ST74 to ST86 is repeated.

With this operation, detection of a multiple paper-conveying error can be immediately resumed with respect to first original O fed after the multiple paper-conveying error is corrected.

Figure 21:
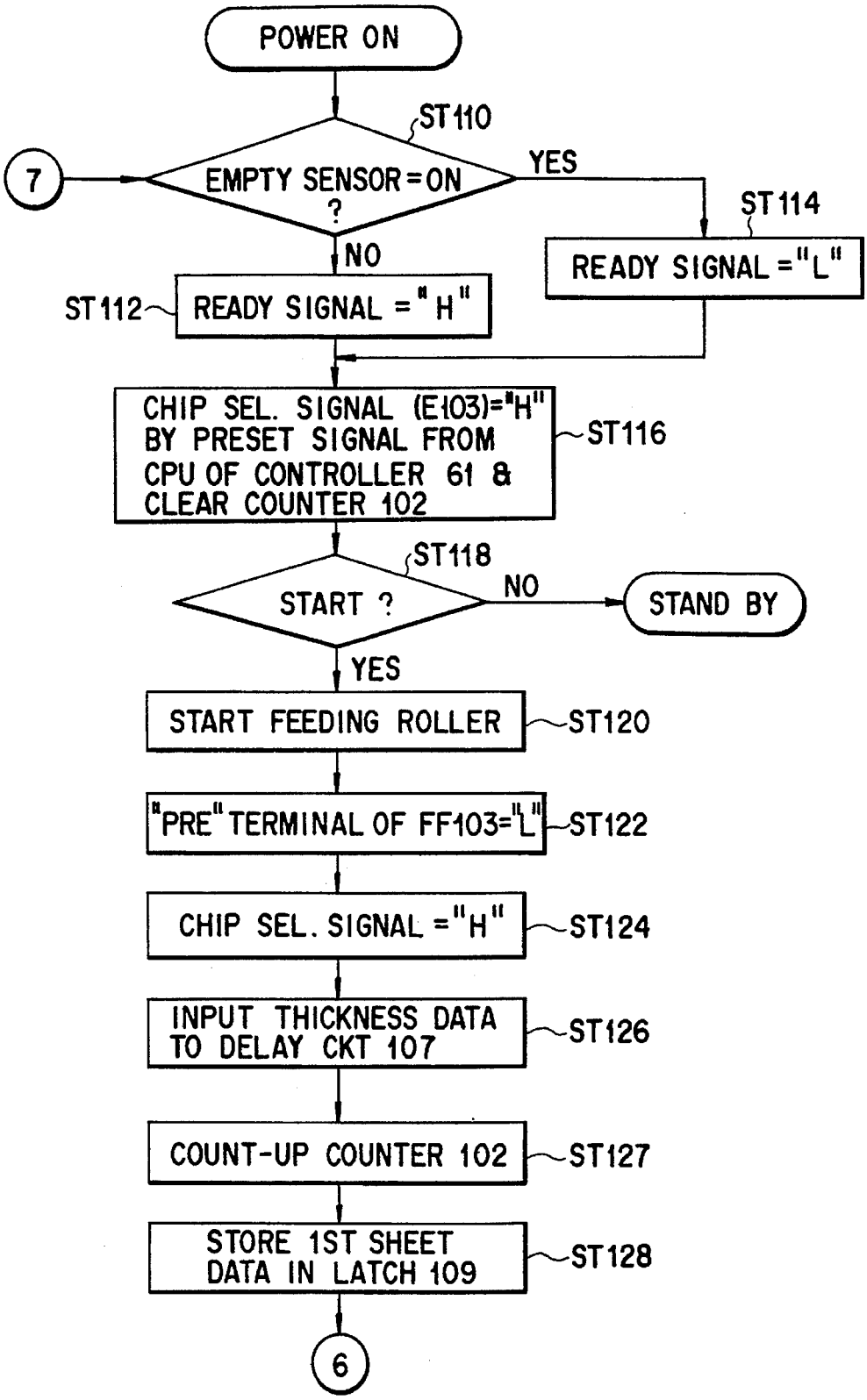
FIG. 21 is a flow chart for explaining a multiple paper-conveying error detecting operation to be performed while originals are separated and fed.
Figure 22:
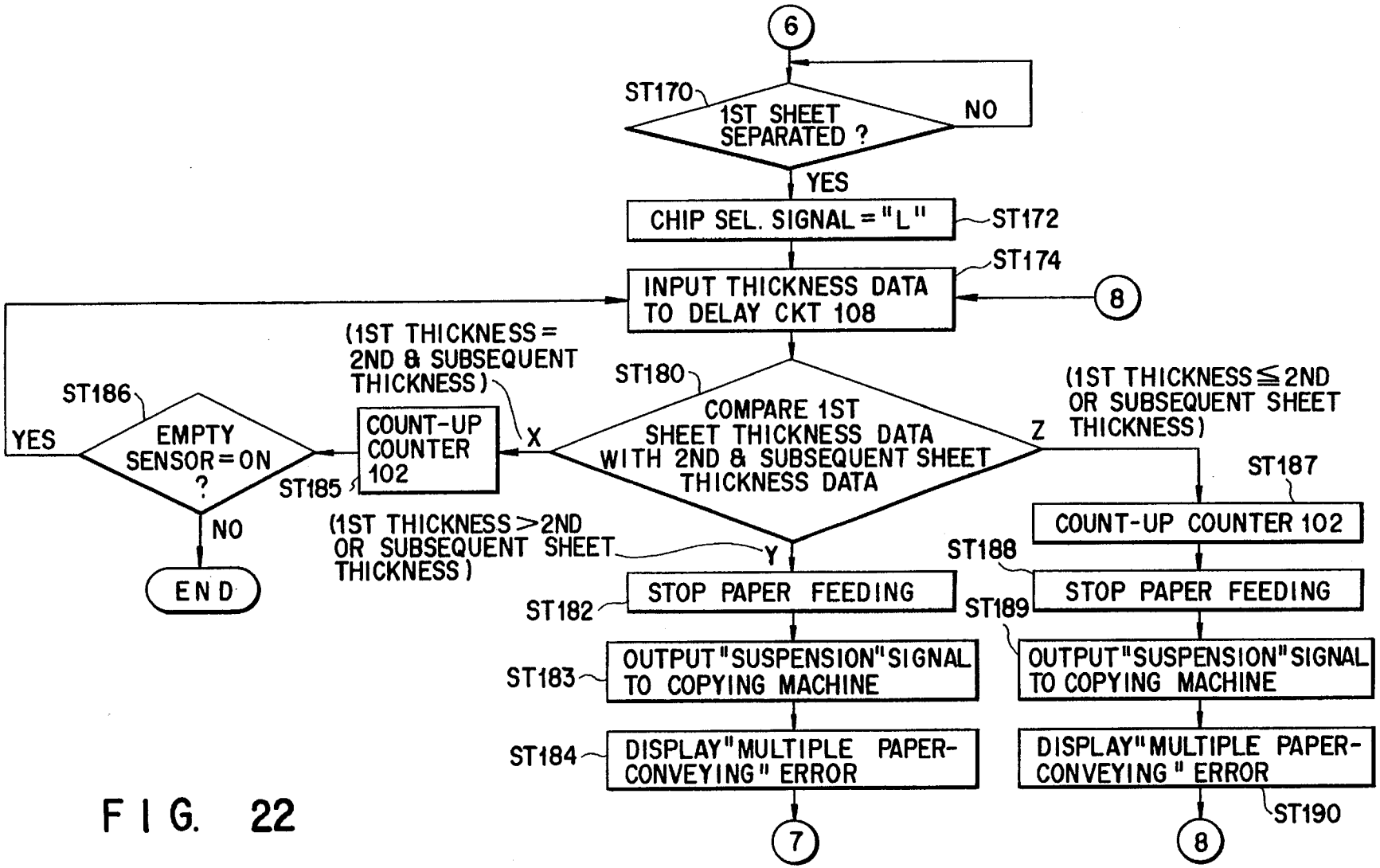
FIG. 22 is a flow chart for explaining a multiple paper-conveying error detecting operation to be performed while originals are separated and fed.

FIGS. 21 and 22 are flow charts showing an operation to be performed in consideration of the count value of sheet counter 102.

When a plurality of originals O are set (placed) on original feeding table 22 en bloc to abut against shutter 26, empty sensor 29 is turned on (YES in step ST110), and an "L"-level ready signal (not shown) is generated (step ST114). If no original O is present, empty sensor 29, is turned off (NO instep ST110), and an "H"-level ready signal is generated (step ST112).

Figure 18:
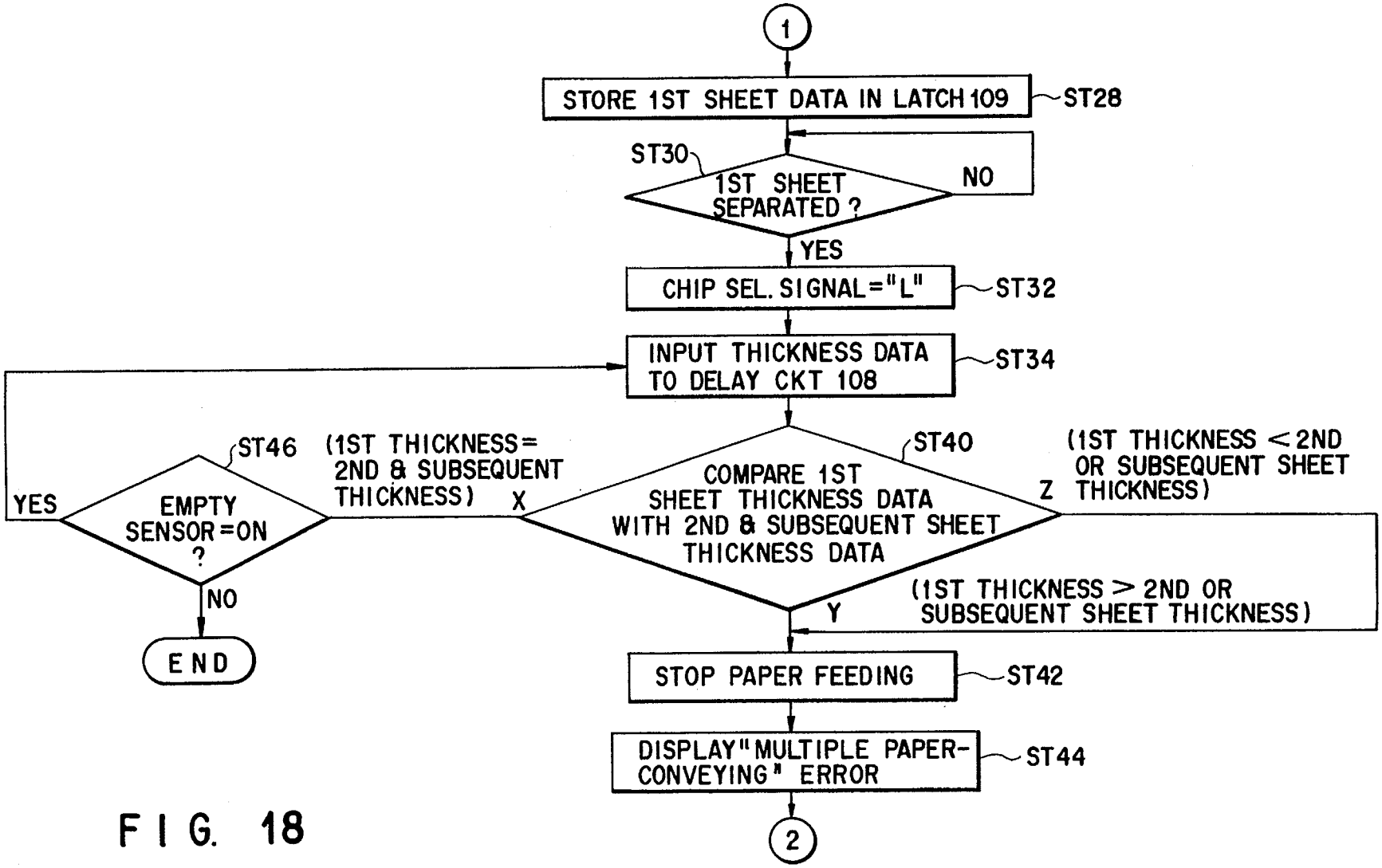
FIG. 18 is a flow chart for explaining a multiple paper-conveying error detecting operation to be performed while originals are separated and fed.

When the "L"-level ready signal is output from empty sensor 29, the CPU of controller 61 in FIG. 8 sends preset signal PS to FF circuit 103 and sheet counter 102 in FIG. 18. With this operation, "H"-level chip select signal E103 is output from FF circuit 103, and counter 102 is simultaneously cleared to "0" (step ST116).

Subsequently, necessary information is input through operation panel 52, and copy key 52*c* is depressed (YES in step ST118). With this operation, controller 61 turns on shutter solenoid 68 and weight board solenoid 70. As a result, weight board 28 restrains originals O from floating, and shutter 26 retreats from paper feeding path 25.

After this operation, the CPU of controller 61 starts feeding motor 62 (step ST120), and outputs "L"-level preset signal PS to the preset terminal of FF circuit 103 (step ST122). As a result, "H"-level chip select signal E103 is output from FF circuit 103 (step ST124).

When "L"-level sampling pulse E101 is generated by timing signal generator 101, outputs E105 and E106 from gates 105 and 106 are respectively set at "L" level and "H" level in response to "H"-level chip select signal E103. As a result, delay circuit 107 is enabled, and delay circuit 108 is disabled. Thickness data (DATA 1) associated with first original O is input to enabled delay circuit 107 (step ST126).

Upon this data input operation, sheet counter 102 is incremented by one (step ST127).

Delay circuit 107 temporarily holds the input thickness data (DATA 1) associated with first original O, and stores the held thickness data (DATA 2) associated with first original O in latch 109 at the timing of next sampling pulse E101 (step ST128).

Subsequently, first original O is separated from the remaining originals by pressure sensitive conductive rubber 33*a* of separation pad 33 (YES in step ST170). When the trailing end of original O is detected by resist sensor 36, the CPU of controller 61 transmits "H"-level preset signal PS to the preset terminal of FF circuit 103. As a result, "L"-level chip select signal E103 is output from FF circuit 103 (step ST172).

When "L"-level sampling pulse E101 is generated by timing signal generator 101, output E105 and E106 from gates 105 and 106 are respectively set at "H" level and "L" level in response to "L"-level chip select signal E103. As a result, delay circuit 108 is enabled, and delay circuit 107 is disabled. Thickness data (DATA 4) associated with second or subsequent original O is input to enabled delay circuit 108 (step ST174).

Delay circuit 108 temporarily holds the input thickness data (DATA 4) associated with second or subsequent original O, and outputs the held thickness data (DATA 5) associated with second or subsequent original O to comparator 110 at the timing of next sampling pulse E101. The thickness data (DATA 3) associated with first original O has been input, as reference data for comparison, from latch 109 to comparator 110.

Comparator 110 compares the thickness data (DATA 3) associated with first original O with thickness data (DATA 5) associated with second or subsequent original O (step ST180).

If DATA 3>DATA 5 (Y at step ST180), it is determined that first original O has undergone multiple paper-conveying. In this case, controller 61 stops the feeding operation (step ST 182), and sends an operation stop signal to copying machine body 1 (step ST183). With this operation, information indicating the occurrence of the multiple paper-conveying error is displayed on the display unit (not shown) of the apparatus (step ST184). When original O which has undergone multiple paper-conveying is properly set again (YES in step ST110), the feeding operation is restarted from step ST118.

If DATA 3< DATA 5 (Z at step ST180), it is determined that second or subsequent original O has undergone multiple paper-conveying. In this case, sheet counter 102 is incremented by one (step ST 187). Thereafter, controller 61 stops the feeding operation (step ST188), and sends an operation stop signal to copying machine body 1 (step ST189). With this operation, information indicating the occurrence of the multiple paper-conveying error is displayed on the display unit (not shown) of the apparatus (step ST190). When second or subsequent original O is released from the multiple paper-conveying condition and properly set again, the feeding operation is restarted from step ST174.

If DATA 3=DATA 5 (X at step ST180), it is determined that no multiple paper-conveying has occurred. In this case, sheet counter 102 is incremented by one (step St185). Thereafter, if any original to be fed is still left, and empty sensor 29 is kept ON (YES in step St186), the operation in steps ST174 to St186 is repeated.

When the shape of original O to be inserted in automatic document feeder 20 is known in advance, data of first original O need not be stored in latch 109 to be compared.

More specifically, originals O to be fed are slips, securities, and the like.

In this case, reference data may be held in a storage means (e.g., a ROM), which is capable of holding data even when the power to the apparatus is turned off, so that a fed state of original O can be determined by comparing the reference data stored in the ROM with data associated with fed original O.

Thickness detector 100 used in a case wherein the size of originals O to be fed is fixed will be described first.

Figure 23:
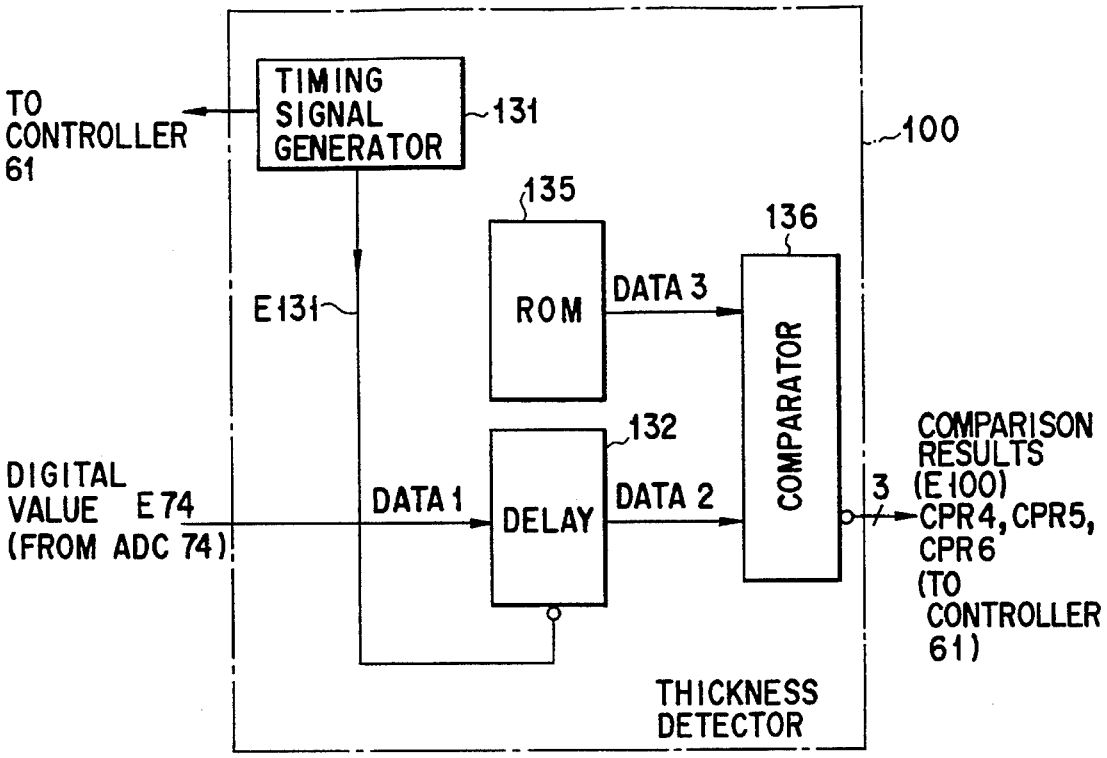
FIG. 23 is a block diagram showing the schematic arrangement of a thickness detector.

As shown in FIG. 23, this thickness detector 100 comprises timing signal generator 131, delay CKT 132, ROM 135, and comparator 136.

According to this arrangement, when the leading end of original O reaches the position between separation pad 33 and feeding roller 31, controller 61 causes timing generator 131 to output a feeding roller operation instruction. In response to the feeding roller operation instruction, feeding roller 31 is rotated.

After an elapse of a predetermined period of time, timing generator 131 of FIG.15 outputs sampling pulse E131 to delay CKT 132 of FIG. 23. With this operation, delay CKT 132 latches digital value E74 (DATA 1) corresponding to output voltage value E74 of detector 73 and supplied from ADC 74.

Comparator 136 then compares data (DATA 3) in a predetermined range, which is based on reference thickness data from ROM 135, with the thickness data (DATA 2) associated with original O and supplied from delay CKT 132. As a result, for example, as shown in Table 1, comparator 136 sets comparison result CPR4 at "L" level when the reference thickness is larger than the thickness of original O; sets comparison result CPR5 at "L" level when the thickness of original O is larger than the reference thickness; and sets comparison result CRP6 at "L" level when the thickness of original O is equal to the reference thickness.

TABLE 1

| | CPR4 | CPR5 | CPR6 |
|---|---|---|---|
| 1 REFERENCE THICKNESS DATA > THICKNESS OF ORIGINAL | L | H | H |
| 2 REFERENCE THICKNESS DATA < THICKNESS OF ORIGINAL | H | L | H |
| 3 REFERENCE THICKNESS DATA = THICKNESS OF ORIGINAL | H | H | L |

When detection signal E100 (CPR4-CPR6) indicating that the thickness of original O is smaller than the reference thickness is supplied from thickness detector 100, controller 61 determines that a different type of original O is conveyed. When detection signal E100 indicating that the thickness of original O is larger than the reference thickness is supplied from thickness detector 100, controller 61 determines multiple paper-conveying of first original O.

Upon determining multiple paper-conveying of original O or conveying of a different type of original O, controller 61 stops the feeding operation, and outputs information indicating the occurrence of the multiple paper-conveying error to main control unit 51. With this operation, main control unit 51 informs the occurrence of the multiple paper-conveying error or conveying of a different type of original O through display unit 52a of operation panel 52.

When a detection signal indicating that the thickness of original O is equal to the reference thickness is supplied from thickness detector 100, controller 61 performs an original scanning operation and paper discharge processing with respect to original O. At the same time, next original O is fed from original feeding table 22 onto original table 2.

Note that when a signal indicating that the thickness of original O is different from the reference thickness is supplied from thickness detector 100, controller 61 may determine a conveying error and stop the feeding operation.

In addition, reference data associated with a plurality of originals O having different thicknesses may be stored in ROM 135 in advance so as to be selected upon address designation performed by controller 61.

Figure 24:
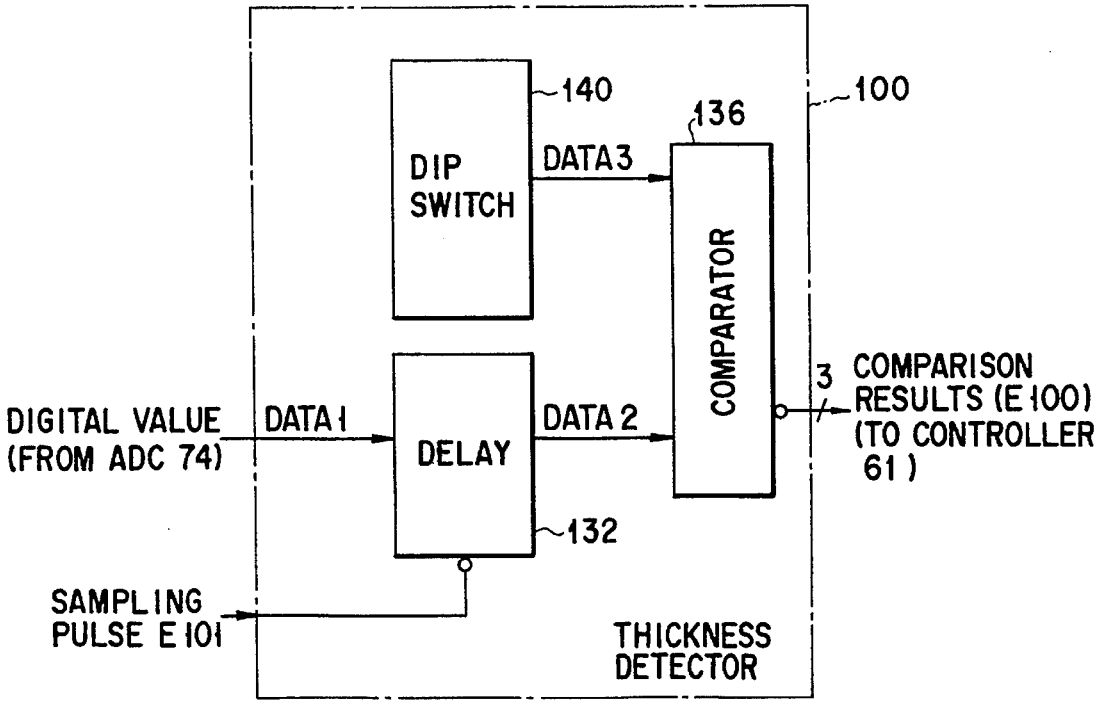
FIG. 24 is a block diagram showing the schematic arrangement of a thickness detector.

Thickness detector 100 described above uses a ROM for storing reference thickness data. However, reference thickness data may be set by using a dip switch or a rotary switch instead. FIG. 24 is a block diagram showing a schematic representation of the circuit for this case. This circuit is constituted by timing signal generator 131, delay CKT 132, dip switch 140, and comparator 136.

Figures 25A, 25B, 25C:
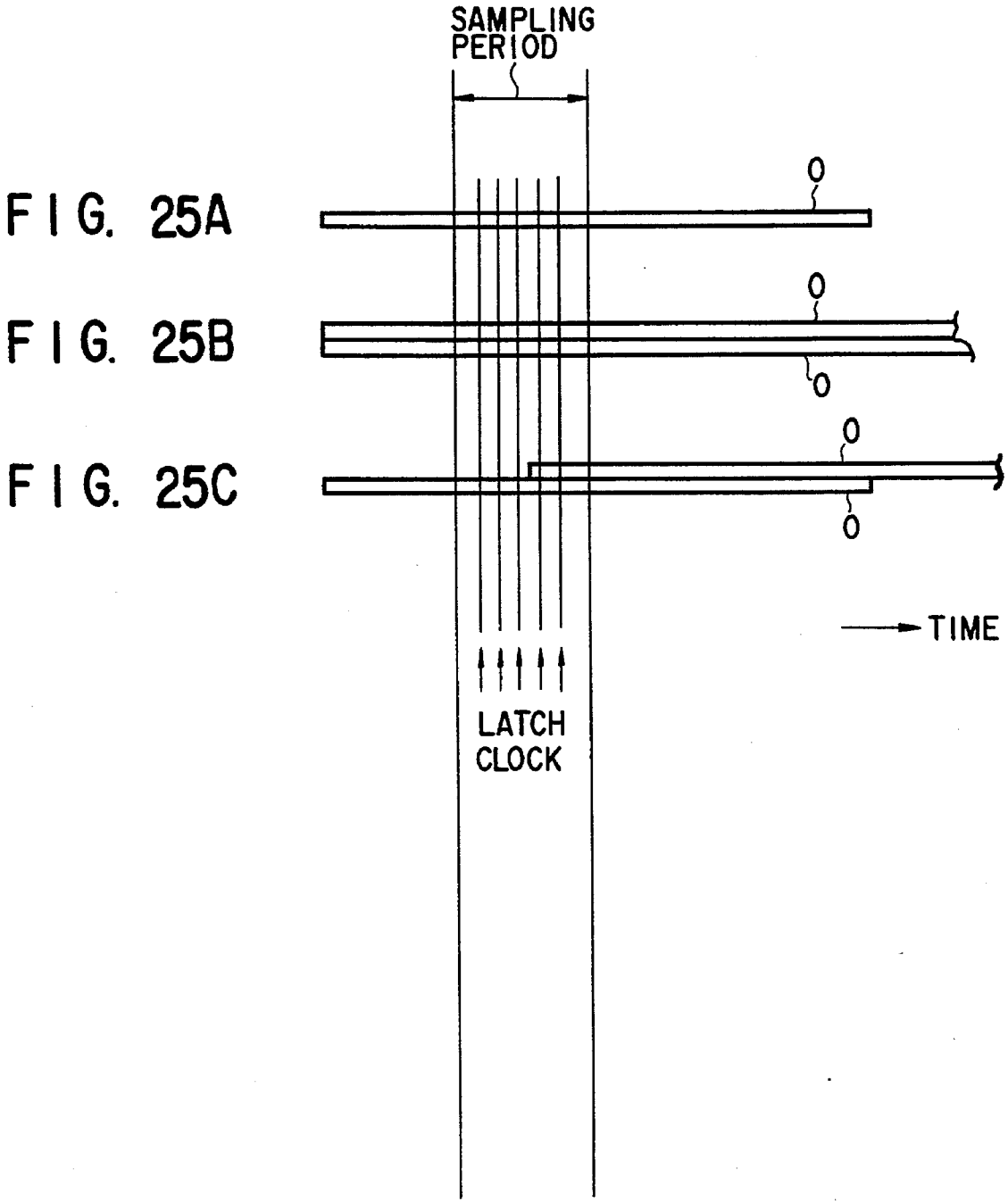
FIGS. 25A to 25C are views for explaining the sampling timing in a state wherein originals are separated and fed.

As shown in FIGS. 25A, 25B, and 25C, when a multiple paper-conveying error occurs while the leading ends of originals O are shifted from each other, the thickness of original O may change during a thickness sampling period.

Figure 26:
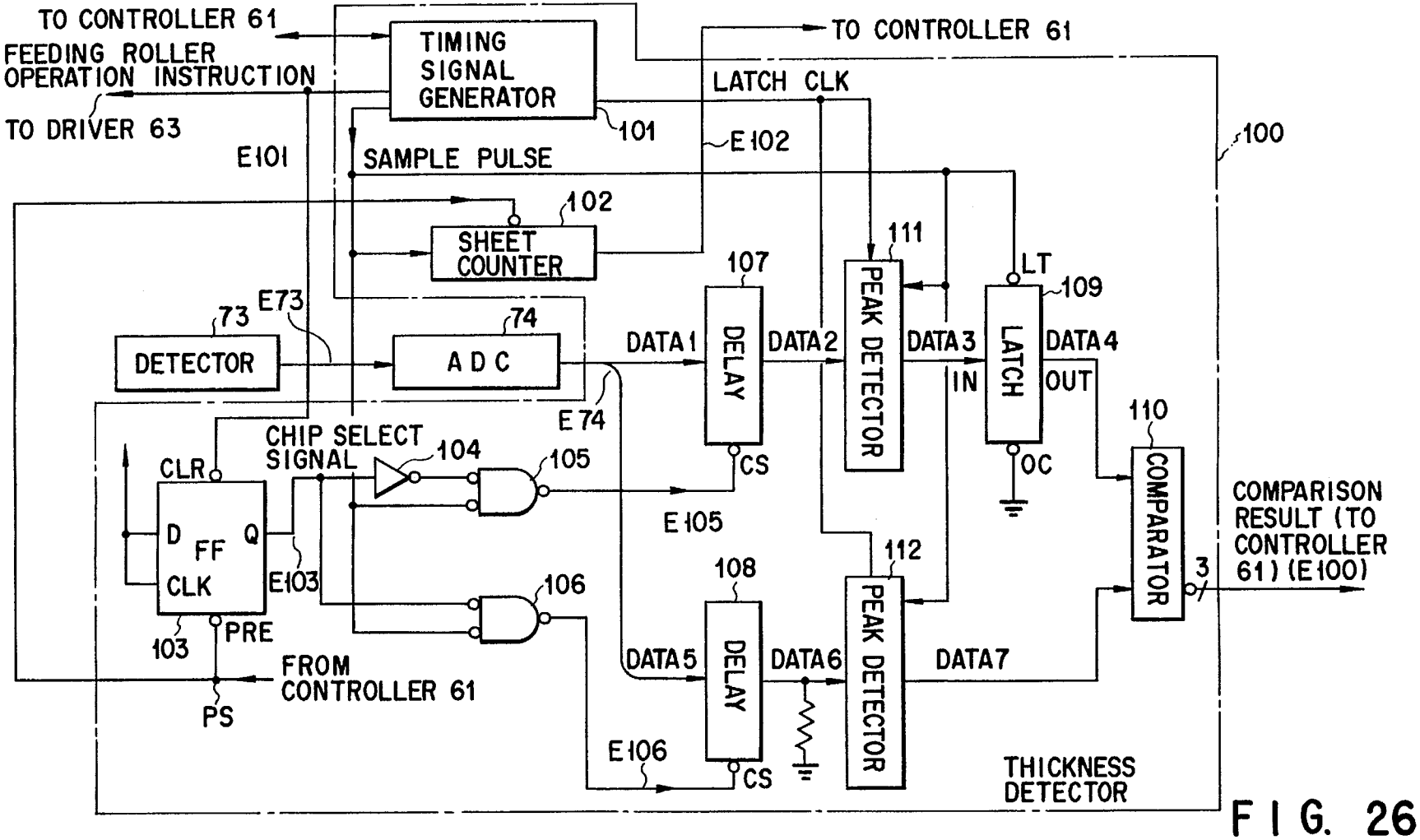
FIG. 26 is a block diagram showing the schematic arrangement of a thickness detector.

In this case, if the maximum value of the thickness is not detected, a detection error may be caused. The above-mentioned problem can be solved by using peak detectors before reference data and the thicknesses of second and subsequent originals O are detected. That is, as shown in FIG. 26, peak detectors 111 and 112 are respectively arranged between delay CKT 107 and latch 109 of thickness detector 100 shown in FIG. 18, and between delay CKT 108 and comparator 110 of thickness detector 100.

Figure 27:
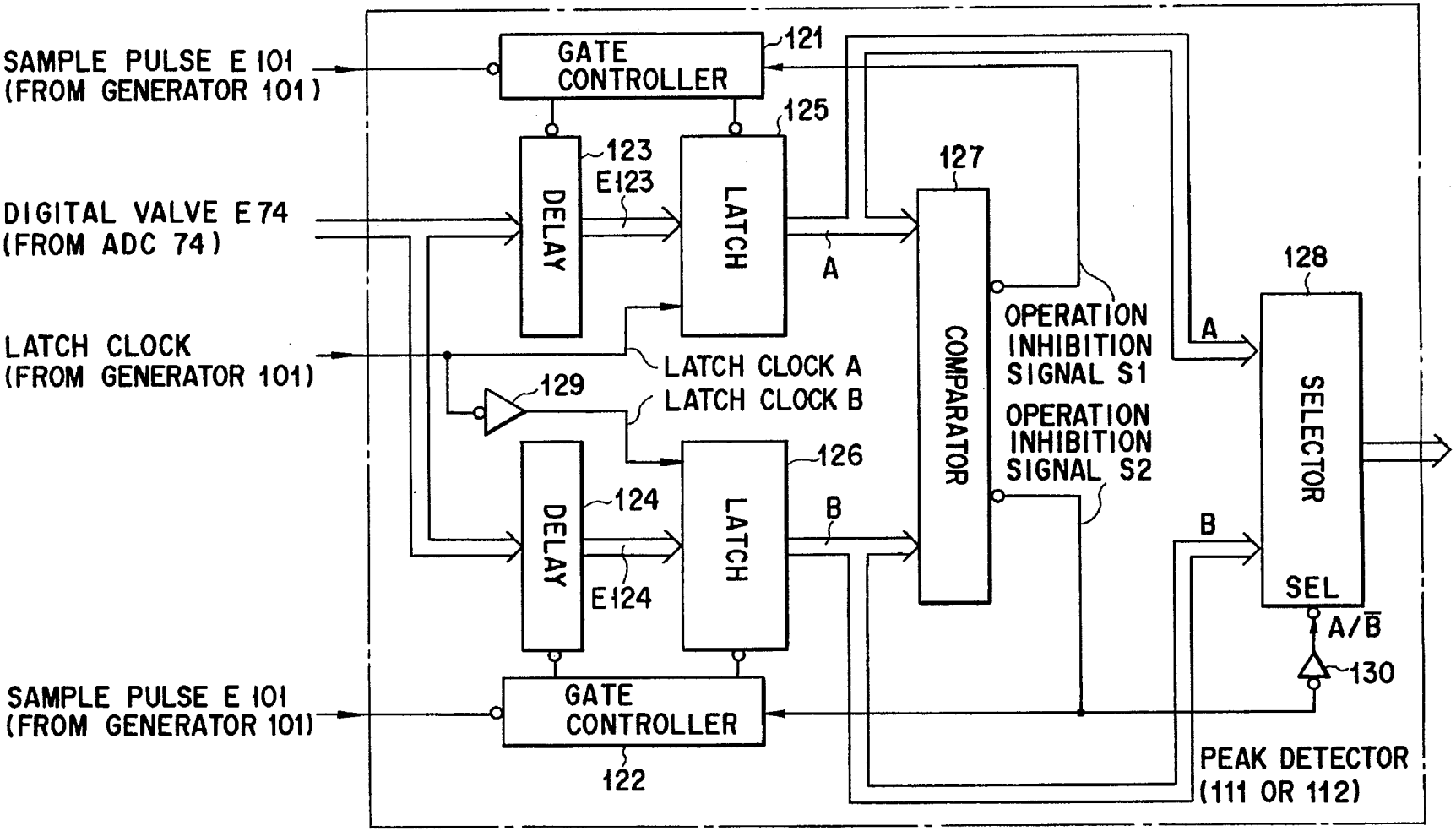
FIG. 27 is a block diagram showing the schematic arrangement of a peak detector.

For example, as shown in FIG. 27, each of peak detectors 111 and 112 is constituted by gate controllers 121 and 122, delay CKTs 123 and 124, latches 125 and 126, comparator 127, selector 128, inverter 129, and inverter 130.

Figures 28A, 28B, 28C:
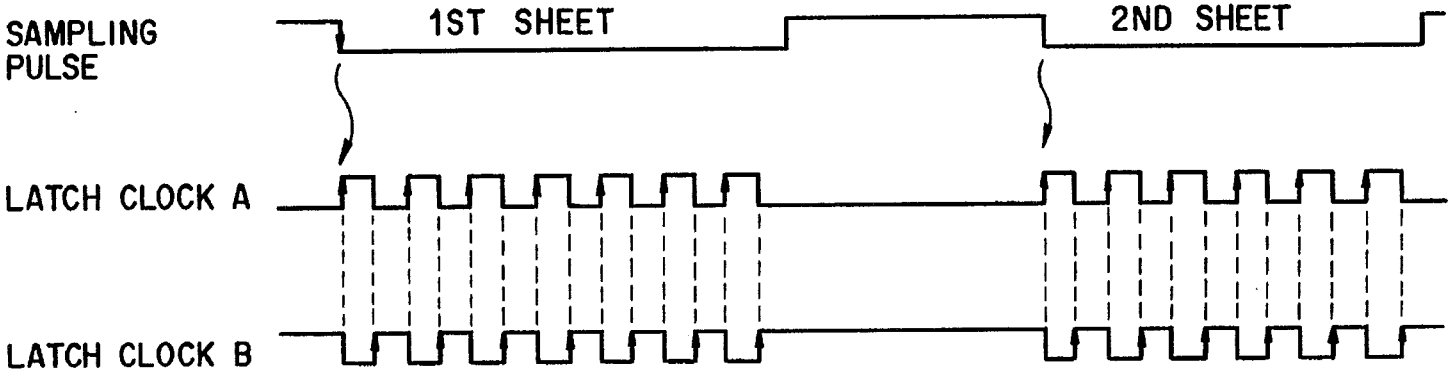
FIGS. 28A to 28C are timing charts for explaining the output timing of a latch clock with respect to a sampling clock.

Timing pulse E101 as shown in FIG. 28A is supplied from timing generator 101 to gate controllers 121 and 122, and digital value E74 from ADC 74 is supplied to latches 125 and 126 via delay CKTs 123 and 124. Latch clock A (see FIG. 28B) from timing generator 101 is supplied to latch 125 without any modification, and latch clock B (see FIG. 28C) obtained by inverting latch clock A through inverter 129 is supplied to latch 126.

Gate controllers 121 and 122 are set in an enabled state when timing pulse E101 from timing generator 101 is set at "L" level, and perform an operation only when original O is present at separation pad 33. In this case, gate controllers 121 and 122 respectively open the gates of delay CKTs 123 and 124.

Gate controller 121 closes the gate of latch 125 to hold the latched content upon receiving operation stop signal S1 ("H" level) from comparator 127 in the above-mentioned enabled state. Gate controller 122 closes the gate of latch 126 to hold the latched content upon receiving operation stop signal S2 ("H" level) from comparator 127 in the above-mentioned enabled state.

A digital value (thickness data) from delay CKT 123 is latched by latch 125 when latch clock A rises while the gate is opened by gate controller 121. This latched content is output to comparator 127 and selector 128.

A digital value (thickness data) from delay CKT 124 is latched by latch 126 when latch clock B rises while the gate is opened by gate controller 122. This latched content is output to comparator 127 and selector 128.

Comparator 127 compares latched content A in latch 125 with latched content B in latch 126. If latched content A in latch 125 is larger than latched content B in latch 126 (A>B), comparator 127 outputs operation stop signal S1 to gate controller 121. Otherwise (B≧A), comparator 127 outputs operation stop signal S2 to gate controller 122. Operation stop signal S2 output from comparator 127 is supplied, as a selection signal, to selector 128 via inverter 130.

When the selection signal supplied from comparator 127 via inverter 130 is at "H" level, selector 128 outputs latched content A from latch 125 to thickness detector 100. When the selection signal is at "L" level, selector 128 outputs latched content B from latch 126 to latch 109 or comparator 110 on the subsequent stage.

An operation in this arrangement will be described below.

When the leading end of original O reaches separation pad 33, a detection voltage obtained by detector 73 is input to delay CKTs 123 and 124. Latches 125 and 126 are designed to latch outputs from delay CKTs 123 and 124, respectively, at the leading edges of latch clocks A and B.

As shown in FIG. 28B, therefore, output E123 from delay CKT 123 is latched by latch 125 first.

At this time, since latch 126 does not operate, its output (B) becomes "0".

The outputs (A, B) from latches 125 and 126 are compared with each other by comparator 127. Since the output (A) of latch 126 is "0", comparator 127 supplies no operation stop signal to gate controller 122 (S2="L" level). At this time, gate controller 122 makes latch 126 ready to receive output E124 from delay CKT 124.

On the other hand, since an operation stop signal (S1="H" level) has been supplied from comparator 127 to gate controller 121, gate controller 121 supplies an operation stop signal to latch 125. Therefore, the first sampled data (E123) is kept held in latch 125 without any modification.

In addition, since an "H"-level selection signal (SEL) is supplied to selector 128, latched content A in latch 125 is output from peak detector 111 or 112.

Since only latch 126 operates at the leading edge of latch clock B, second sampled data E124 (or thickness data E74 of the second original) is latched by latch 126. In this case, the data (B) latched by latch 126 is compared with the data (A) latched by latch 125 by comparator 127.

If latched data A in latch 125 is larger than latched data B in latch 126 (A>B), latched data A is kept held in latch 125 again. Latch 126 then latches data E124 from delay CKT 124 at the leading edge of next latch clock B.

If latched data A in delay CKT 125 is equal to or smaller than latched data B in latch 126 (A≦B), comparator 127 supplies no operation stop signal to gate controller 121 (S1="L" level). With this operation, gate controller 121 makes latch 125 ready to latch the data (E123) from delay CKT 123.

In contrast to this, since an operation stop signal (S2="H" level) is supplied from comparator 127 to gate controller 122, gate controller 122 supplies an operation stop signal to latch 126. As a result, the second sampled data (E124) is kept held in latch 126 without any modification.

An "L"-level selection signal (SEL) is supplied to selector 128. Therefore, latched content B in latch 126 is output to latch 109 or comparator 110 on the subsequent stage.

In this manner, currently sampled data (E124 or E123) is compared with previously sampled data (E123 or E124), and larger data is held at the latch (125 or 126).

Finally, if latched data A in latch 125 is equal to or larger than latched data B in latch 126 (A≧B), latched data A is output from peak detector 111 or 112. Otherwise, latched data B is output to latch 109 or comparator 110 on the subsequent stage, if latched data A is smaller than latched data B (A<B).

In this circuit arrangement, larger data of data in latches 125 and 126 are sequentially output to latch 109 or comparator 110 on the subsequent stage. Finally, the maximum value of the thickness of one original O is stored in latch 109 or output to comparator 110.

With this arrangement, even if originals O have different sizes, a conveyed state of original O can be accurately detected without erroneously detecting a multiple paper-conveying error.

As described above, a multiple paper-conveying error and a jam can be detected by detecting the displacement amount of the pressure sensitive conductive rubber at the separation portion of automatic document feeder 20. When an original is fed while a multiple paper-conveying error is caused, a skew may occur owing to uneven thickness, and the original is pressed against a side surface of the convey path to be bent. In the worst case, the original may be torn off. Since a feeding operation can be stopped immediately after the occurrence of a multiple paper-conveying error by performing detection at the separation portion, such a trouble can be prevented.

Another embodiment of the present invention will be described below.

In the above-described embodiment, pressure sensitive conductive rubber **33*a*** has both the separation function and the multiple paper-conveying error detection function.

Figure 29:
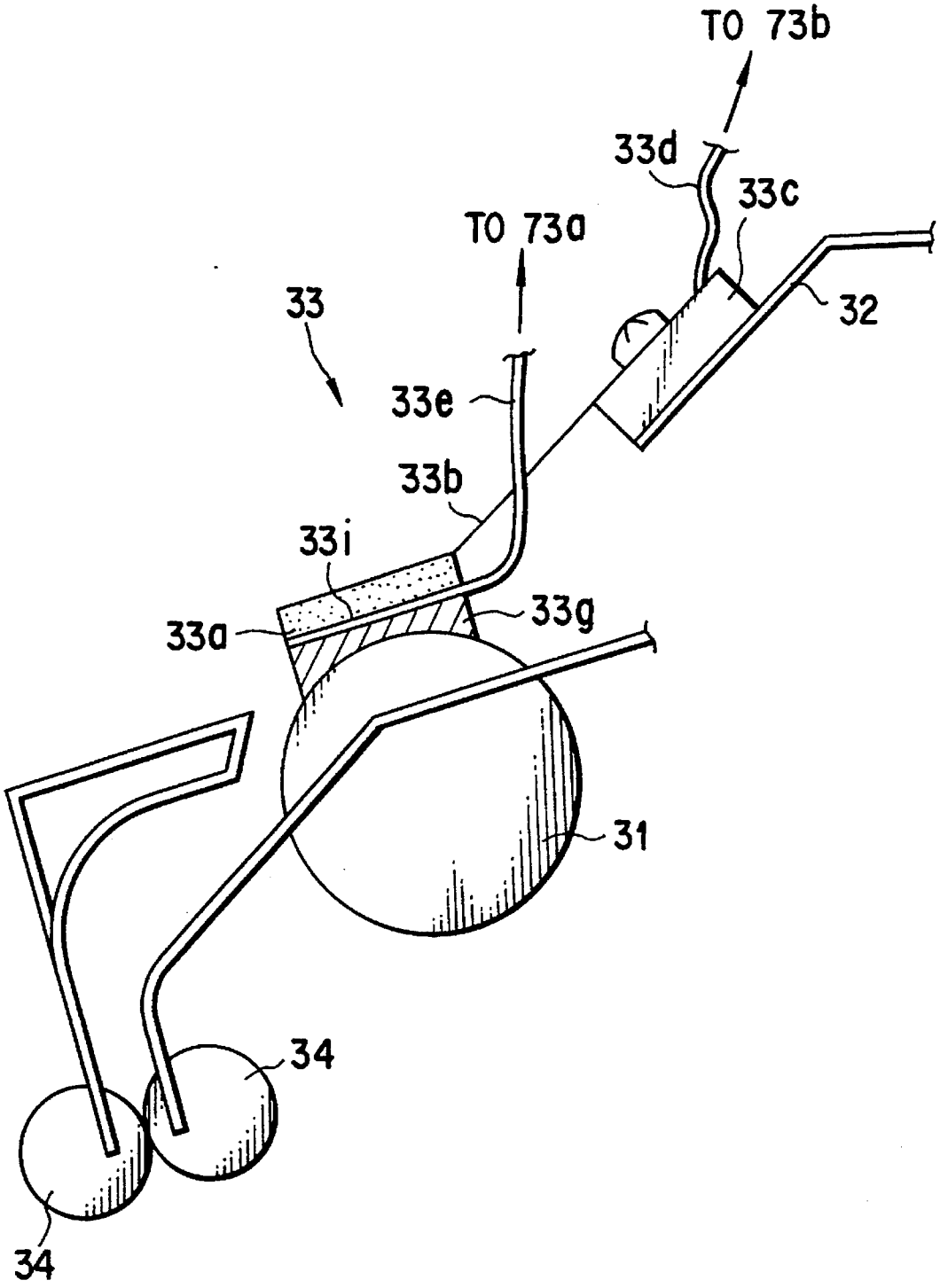
FIG. 29 is a view for explaining another arrangement of the separation pad.

FIG. 29 shows a case wherein electrode layer 33i is formed inside a separation pad.

In this case, there is no need to form a signal detection electrode on a portion, of the separation pad, which is in contact with feeding roller 31.

For this reason, the surface of the separation portion can be made uniform to further improve the stability of the separation function.

As shown in FIG. 29, the area of electrode layer **33*i* can be made equal to that of the end face of pressure sensitive conductive rubber 33*a*. Since a change in resistance value of pressure sensitive conductive rubber 33*a*** can be basically detected only in a direction perpendicular to the electrode, a signal can be efficiently obtained with this arrangement.

In addition, if a rubber having an excellent separation function (e.g., urethane rubber) is used as a material for a portion, of the separation pad, which is in contact with feeding roller 31, an excellent separation function can be ensured. This means that even if the friction coefficient of the surface of an optimal pressure sensitive conductive rubber for detection of a multiple paper-conveying error is insufficient for a desired separation function, the desired separation function can be ensured.

Figure 30A:
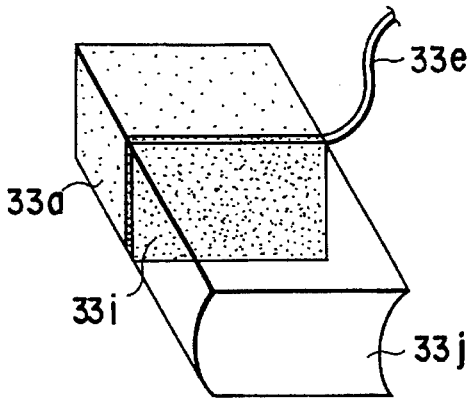
FIGS. 30A to 30C are views for explaining the main parts of separation pads.

As a method of forming a separation pad, a method of insert-molding a support plate and a metal plate as an electrode layer into one piece is available. In this case, different types of rubbers can also be used for a separation portion and a portion for detecting a multiple paper-conveying error. FIG. 30A shows an example of separation pad 33 formed by this method.

Alternatively, a separation pad may be manufactured by bonding metal plate **33*i*, pressure sensitive conductive rubber 33*a*, and separation rubber 33*j*** to each other with a conductive adhesive.

Figure 30B:
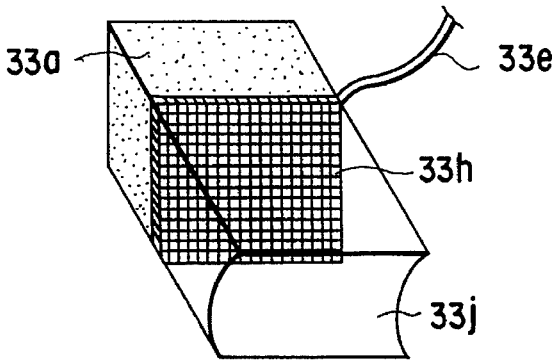
Figure 30C:
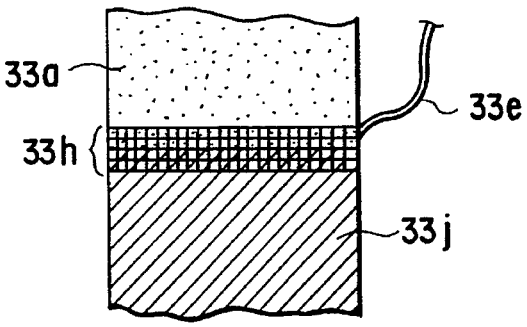

If an intermediate electrode is made of a plain weave line member, and a separation pad is formed by insert molding, as shown in FIGS. 30B and 30C, pressure sensitive conductive rubber 33*a* and separation rubber 33*j* penetrate plain weave line member 33*k* to increase the mechanical strength.

As this intermediate electrode, a conductive ink layer formed by the thick-film printing method or a flexible substrate may be used, as described above.

Figure 31:
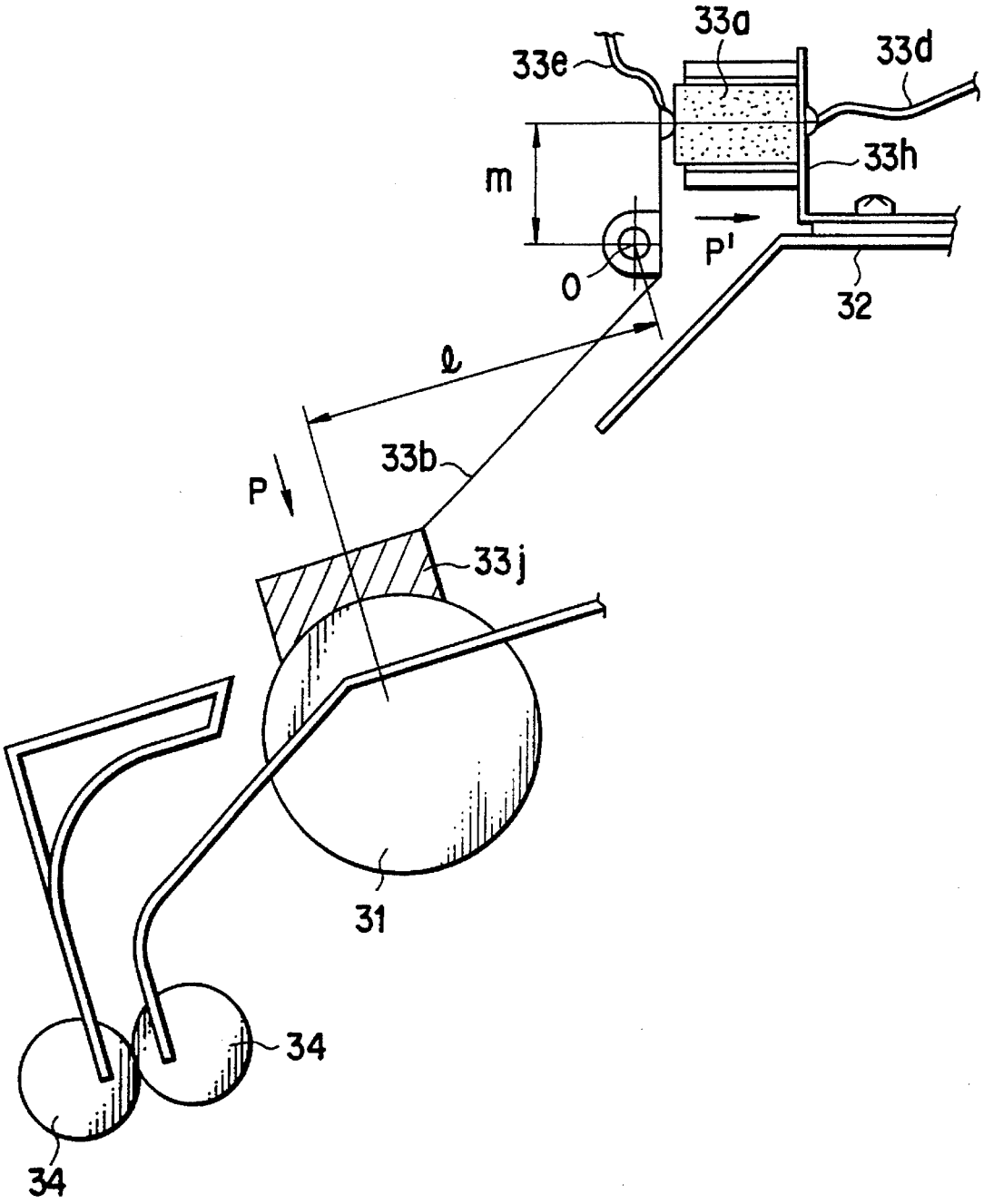
FIG. 31 is a sectional view for explaining another arrangement of the separation pad.

FIG. 31 shows an embodiment in which pressure sensitive conductive rubber 33*a* is pressed through link 33*b*. Let P be the pressure applied to feeding roller 31, $\mu_0$ be the friction coefficient between original O and separation rubber 33*j*, $\mu_1$ be the friction coefficient between originals O, and $\mu_2$ be the friction coefficient between feeding roller 31 and original O.

In this case, the conveying force of feeding roller 31 is represented by $T_2=\mu_2\times P$; a force restraining the upper surface of original O in a direction opposite to the conveying direction is represented by $T_0=\mu_0\times P$; and a force for moving a plurality of originals O between originals O in the same direction is represented by $T_1=\mu_1\times P$. In this case, the condition of reliable separation/conveyance of only original O at the lowermost position is expressed by T2>T0> T1.

If pressure P applied to separation pad 33 which satisfies the above condition is not applied to the optimal detection area of pressure sensitive conductive rubber 33*a*, both the separation function and the multiple paper-conveying error detection function cannot be satisfied simultaneously.

Figure 32:
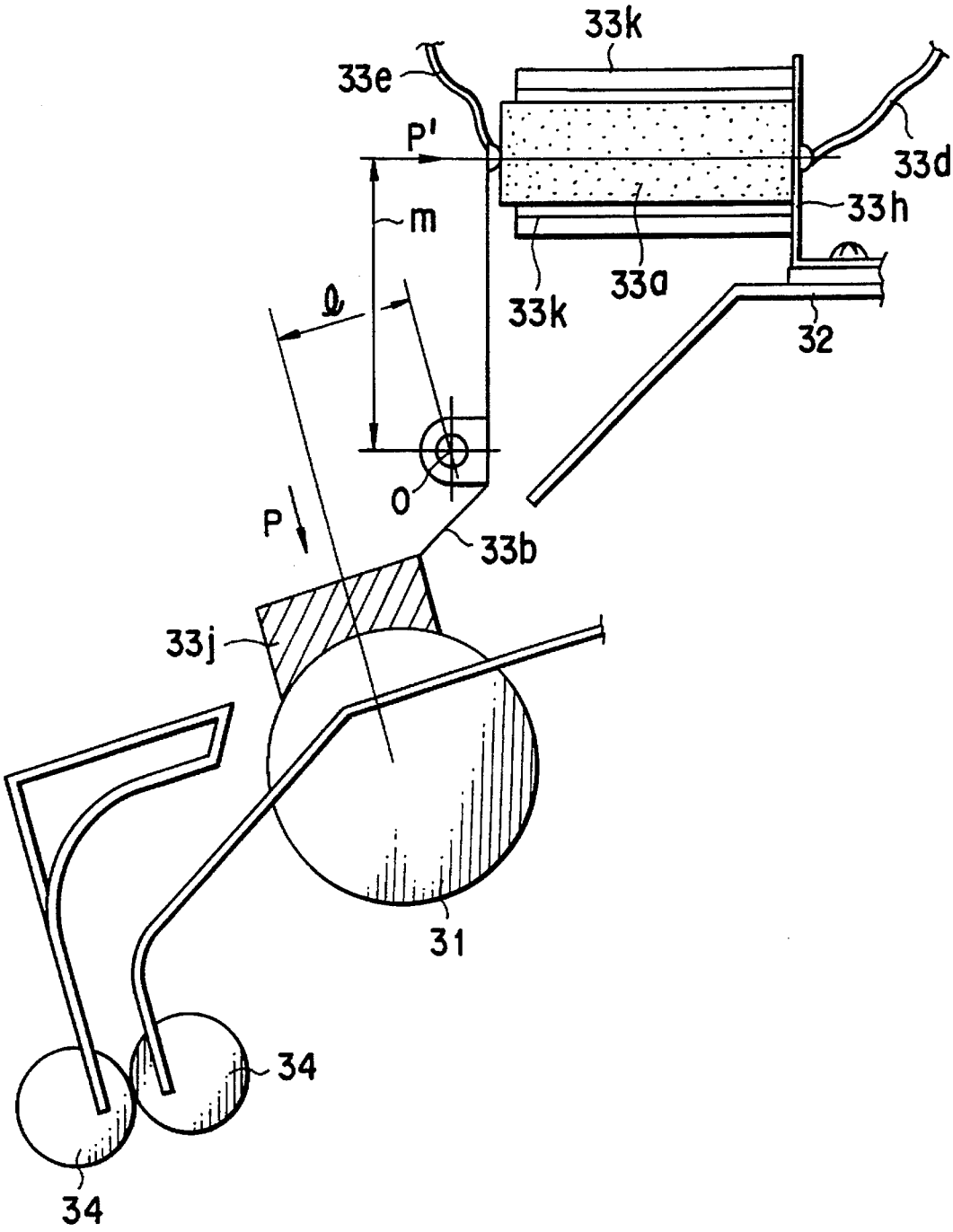
FIG. 32 is a sectional view for explaining still another arrangement of the separation pad.

If, therefore, a pressure is applied to pressure sensitive conductive rubber 33*a* via link 33*b*, since P=m×P'/1 in FIG. 32, pressure P' can be set on the optimal detection area of pressure sensitive conductive rubber 33*a* by optimizing the ratio of m/1.

Figure 33:
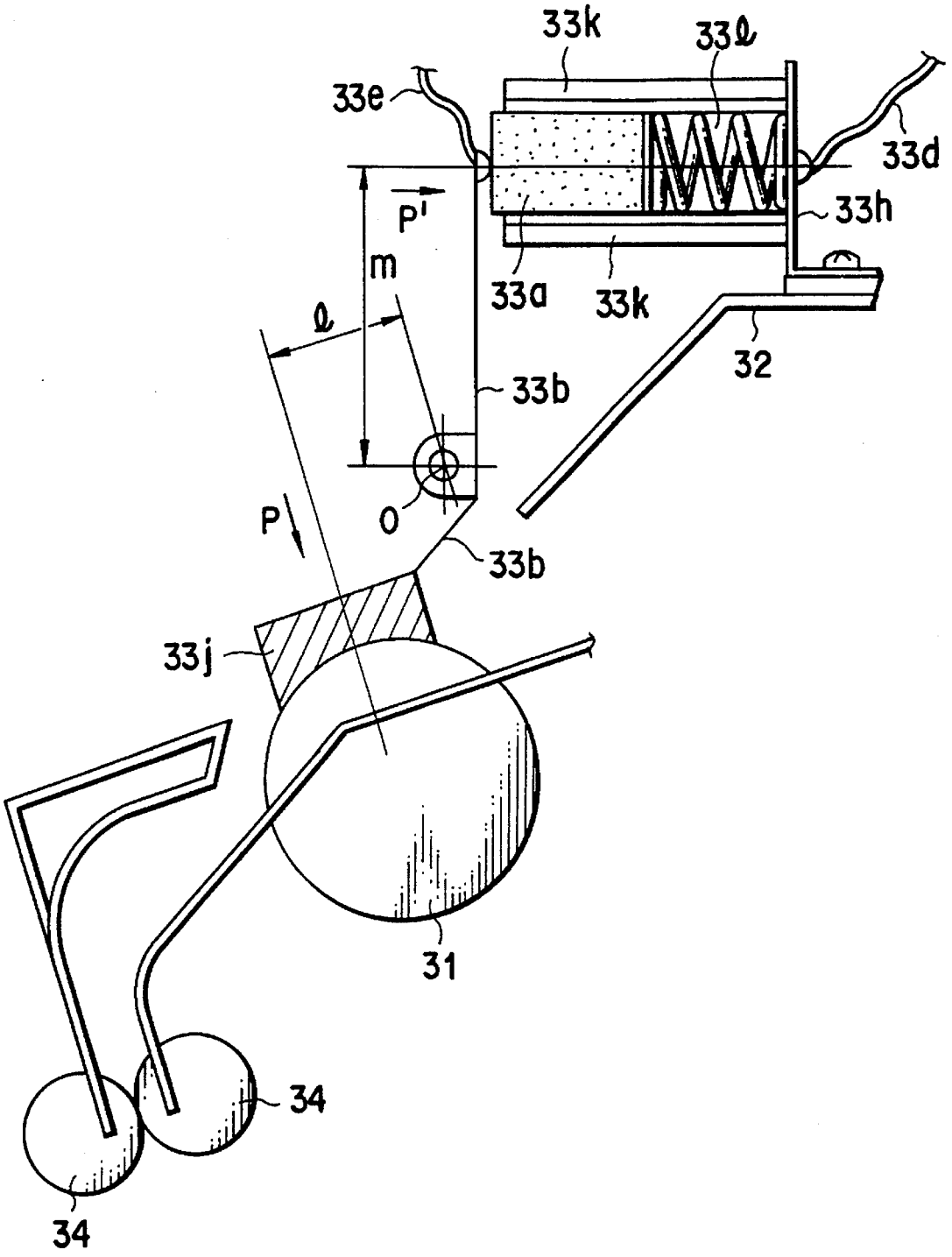
FIG. 33 is a sectional view for explaining still another arrangement of the separation pad.

FIG. 33 shows an embodiment in which feeding roller 31 is pressed by pressure sensitive conductive rubber 33*a* and auxiliary spring 33*l*. Pressure sensitive conductive rubber 33*a* and auxiliary spring 33*l* are arranged in the same phase with respect to the direction in which a pressure is applied.

Pressure P applied to separation rubber 33*j* is converted into pressure P' through link 33*b*, as described above.

Letting P'1 be the pressure applied to auxiliary spring 33*l*, and $P'_2$ be the pressure applied to pressure sensitive conductive rubber 33*a*, $P'=P'_1+P'_2$ can be established. Therefore, by selectively setting pressure $P'_1$ applied to auxiliary spring 33*l*, pressure $P'_2$ applied to pressure sensitive conductive rubber 33*a* can be more easily set on the optimal detection area for detection of a multiple paper-conveying error.

Figure 34:
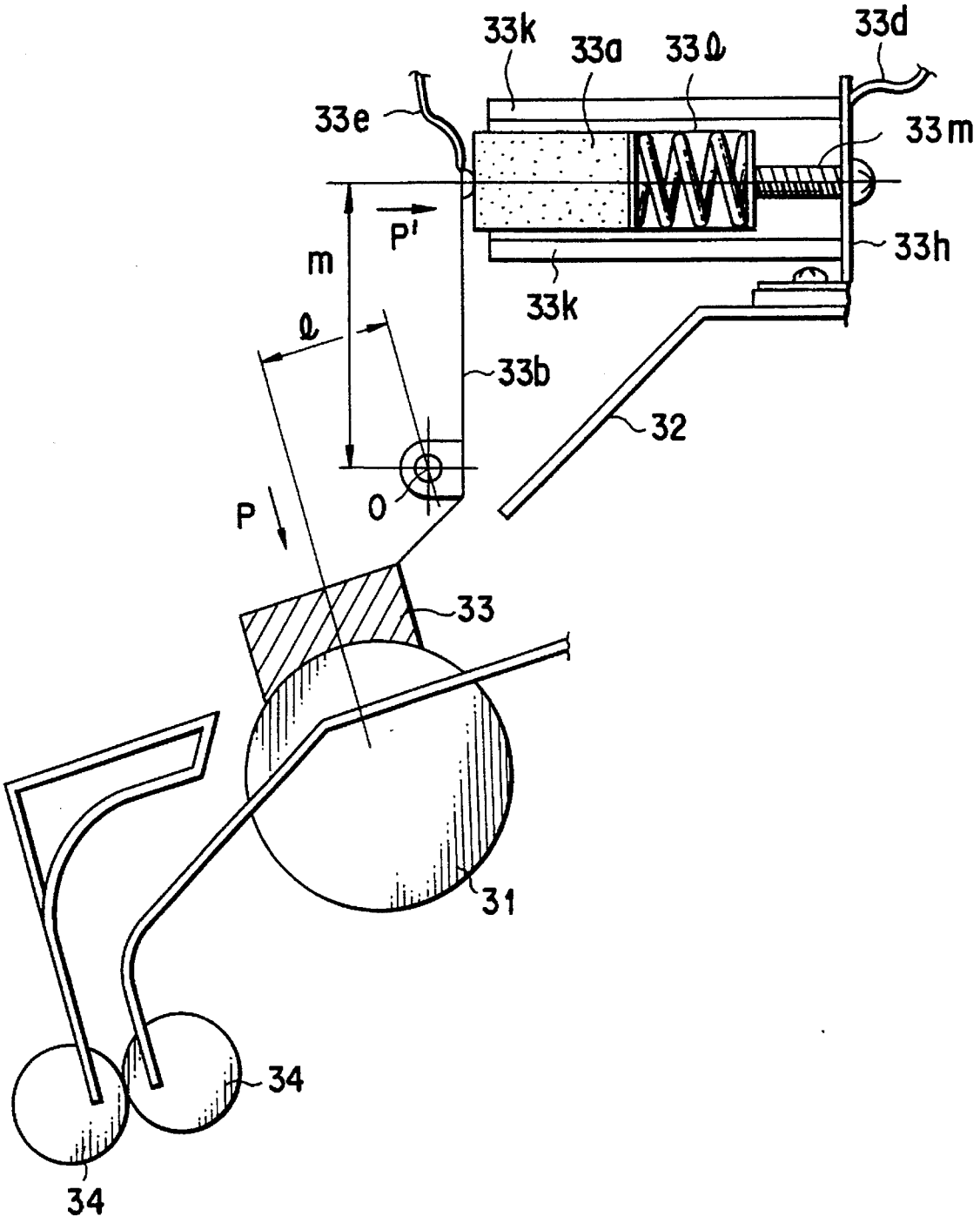
FIG. 34 is a sectional view for explaining still another arrangement of the separation pad.

FIG. 34 shows an embodiment in which mechanism 33*m* is additionally arranged to adjust the pressures applied to pressure sensitive conductive rubber 33*a* and auxiliary spring 33*l*. With this addition of the adjustment mechanism, even if the pressure applied for the separation function decreases after repetitive pressing operations because of fatigue, the pressure can be restored to the original pressure.

In addition, the degree of freedom in setting a pressure which satisfies both the separation function and the multiple paper-conveying error detection function can be increased.

As described above, by reading a change in resistance value corresponding to the pressure applied to pressure sensitive conductive rubber 33*a*, not only a multiple paper-conveying error but also a jam can be detected in automatic document feeder 20.

Automatic document feeder 20 has been described above as an application of the present invention. However, the present invention can also be applied to a printer and an automatic double-sided paper feeder.

Automatic document feeder 20 is mounted on original table 2 of copying machine body 1 so as to be opened/closed with respect to original table 2. With this arrangement, if the pressure normally applied to separation pad 33 is released when automatic document feeder 20 is in an open state, an output from detector 73 which accompanies a change in resistance value of pressure sensitive conductive rubber 33*a* in separation pad 33 becomes smaller than an output from detector 73 which is obtained when no original O is fetched by separation pad 33 in a normal operation.

By detecting the difference between these outputs, an open state of automatic document feeder 20 can be detected. With this detection, the feeding operation is stopped, thereby preventing an operation error.

A conventional apparatus requires a special switch for detecting an open state of automatic document feeder 20. With the above-described arrangement, however, such a special switch need not be used, and hence inexpensive automatic document feeder 20 can be realized.

This embodiment will be described below.

Figure 36:
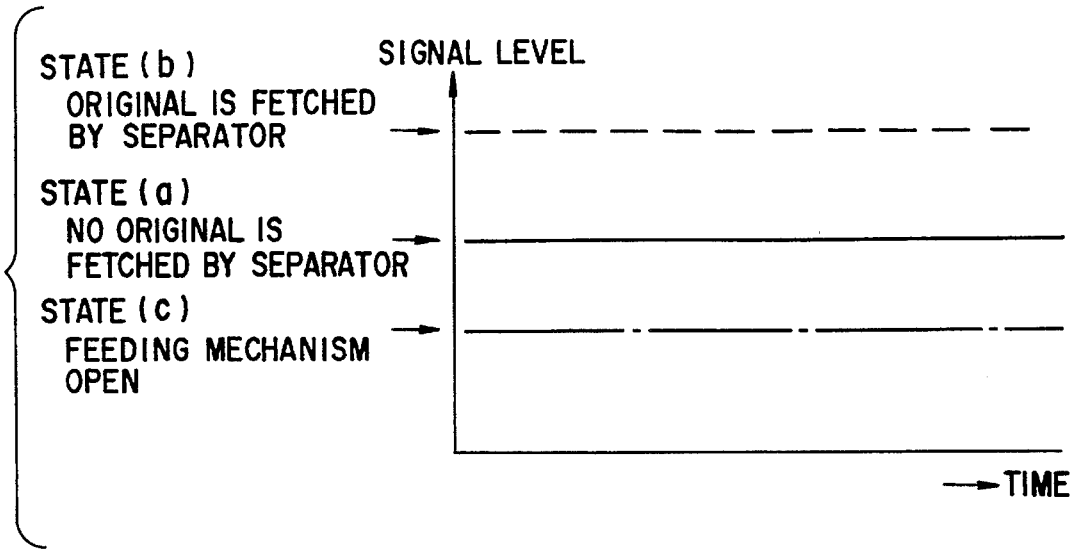
FIG. 36 is a chart for explaining output signals from the detector in three states (conditions) with respect to the separation pad.

Detector 73 (ADC 74) is designed to output signals like those shown in FIG. 36 with respect to three states (conditions) of separation pad 33.

When no original O is fetched by the separator, detector 73 outputs a signal of level (a) shown in FIG. 36.

When original O is fetched by the separator, detector 73 outputs a signal of level (b) shown in FIG. 36.

Figure 35:
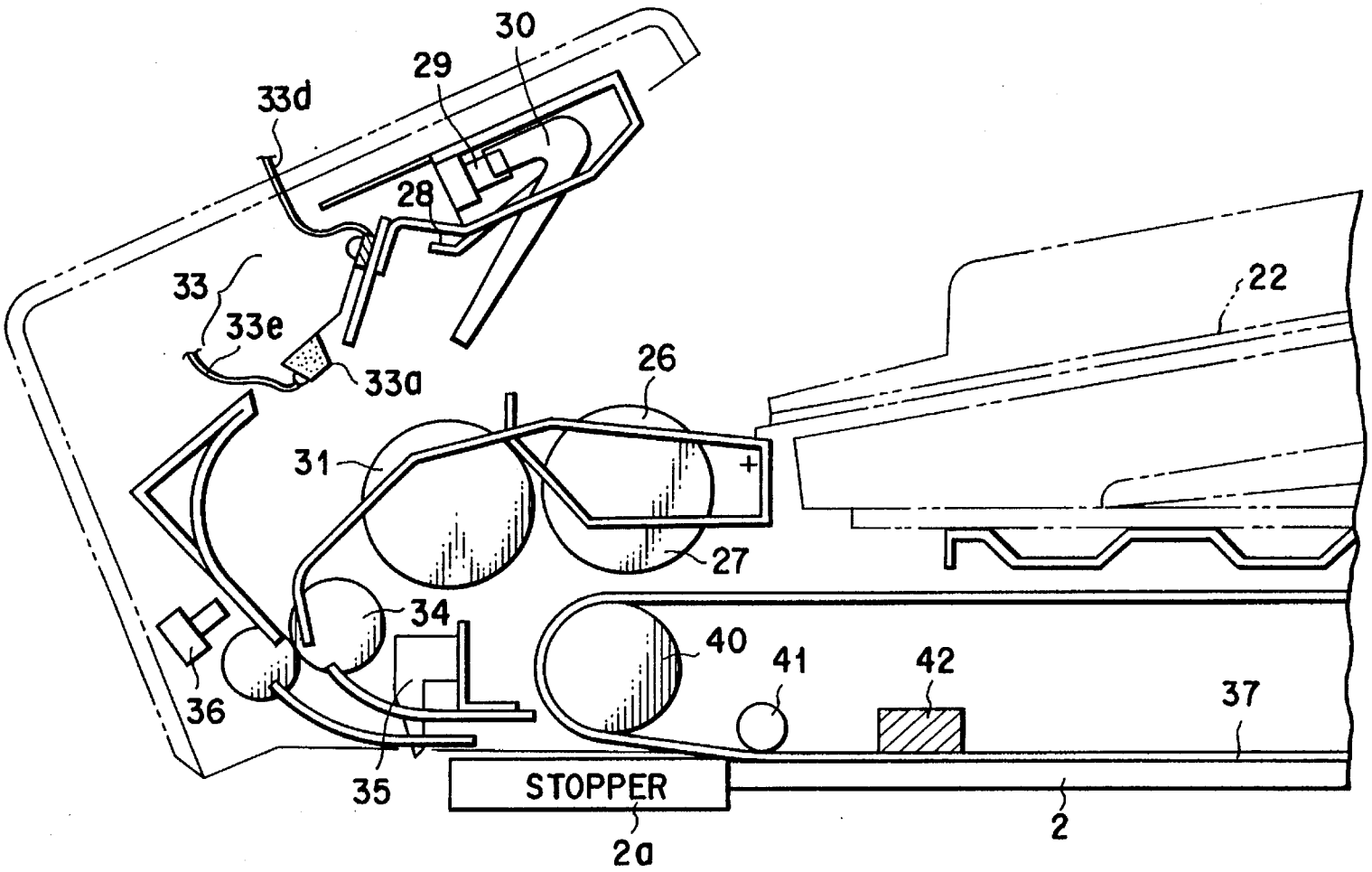
FIG. 35 is a sectional view for explaining an open state of an automatic document feeder.

In the case shown in FIG. 35, automatic document feeder 20 is in an open state, and a signal of level (c) shown in FIG. 36 is output from detector 73.

In the case shown in FIG. 36, as the pressure applied to separation pad 33 increases, signals of higher levels are output from detector 73 in accordance with the respective conditions.

One of the above embodiments will be described below first.

At the time of setting after an unpacking operation, or at the time of shipment, before automatic document feeder 20 is used, a service mode is set through the main apparatus or operation panel 52 of automatic document feeder 20.

To set this service mode, input mode switching key 52*d* and clear key 52*e* of operation panel 52 are depressed at once. Main control unit 51 and controller 61 are then set in the service mode by the resultant signal.

The service mode may be set by other methods.

In addition, an open/closed state of automatic document feeder 20 may be detected by a special circuit.

Figure 37:
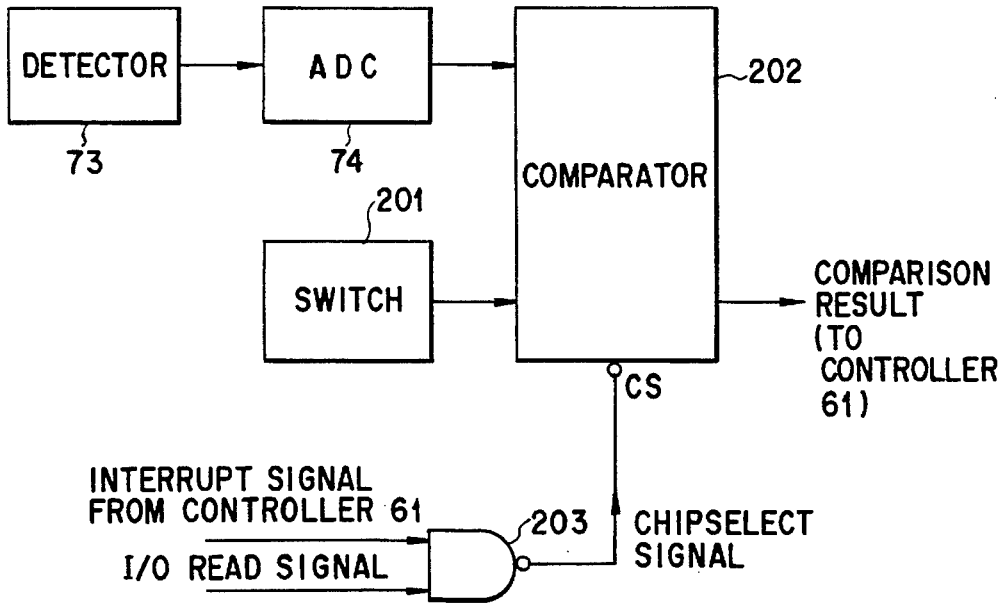
FIG. 37 is a block diagram showing a circuit for detecting an open/closed state of the automatic document feeder.

FIG. 37 shows an embodiment of this circuit. In this case, data corresponding to an output from detector 73 which is obtained when no original is fetched by the separator in a normal operation is set by switch 201 at the time of setting after an unpacking operation or at the time of shipment. An output from detector 73 is converted into digital data by ADC 74 and constantly input to comparator 202. Terminal CS of comparator 202 is connected to the output of AND gate 203. AND gate 203 receives an interrupt signal from controller 61 and an I/O read signal.

That is, an output from comparator 202 is supplied to controller 61 only when an interrupt signal from controller 61 and an I/O read signal are generated simultaneously.

With this arrangement, controller 61 can detect an open/closed state of automatic document feeder 20 as needed while no other processing is performed.

As described in detail above, according to the present invention, there is provided a paper feeding apparatus in which a pressure sensitive conductive rubber is used for a separation pad so as to detect a multiple paper-conveying error by converting a change in thickness of an original into electrical signals so that multiple paper-conveying of originals can be reliably detected. Then, an image read operation or an image forming operation can be continued immediately after the detection of multiple paper-conveying, and the normal state can be easily restored.

By applying the pressure sensitive conductive rubber to a separation means, a multiple paper-conveying error can be detected immediately after it occurs, thus allowing quick restoration to a normal state after the occurrence of an error.

The amount of change in thickness of a paper sheet can be detected by converting a change in resistance value, corresponding to the displacement amount of the pressure sensitive conductive rubber, into a voltage or current value.

Since the pressure sensitive conductive rubber has both functions of separating the fed-originals and detecting the multiple paper-conveying, a multiple paper-conveying error can be detected while effectively suppressing an increase in cost.

Since the support plate serves as part of an electrode, the number of components can be decreased, and high reliability can be ensured with a simple structure.

A conductive ink layer is formed on a portion of the surface of the separation pad which is in contact with the feeding roller so that damage to the feeding roller which is caused when a signal detection electrode is constituted by a metal member can be prevented. In addition, since the gap between the conductive ink layer and the separation rubber can be minimized, the reliability of the separation performance can be ensured.

By forming a flexible substrate as an electrode on a portion of the surface of the separation pad which is in contact with the feeding roller, connection of signal lines is facilitated by soldering.

By forming an electrode layer between the surface of the separation pad, which is in contact with the feeding roller, and the support plate, a change in resistance value which accompanies a change in pressure applied to the pressure sensitive conductive rubber can be detected on the entire surface that receives the pressure. Therefore, efficient signal detection can be realized.

If the intermediate electrode is made of a metal, the separation pad including the electrode can be integrally formed. As a result, the manufacturing cost of components can be reduced, and the mechanical strength between the electrode and the rubber can be increased.

By forming an intermediate layer using a conductive ink containing conductive particles, a uniform electrode can be formed on the entire surface of a conductive rubber. Therefore, the reliability of signal detection can be ensured.

By forming a conductive layer constituted by a plain weave line member as an intermediate layer, a conductive layer is formed by molding such that both a conductive rubber layer and a separation rubber layer penetrate the conductive layer. With this structure, after molding, the mechanical strength between the conductive rubber layer and the separation rubber layer can be ensured.

Since the separation pad member has a dual structure constituted by the pressure sensitive conductive rubber and the separation rubber, the function of detecting a multiple paper-conveying error on the basis of a change in pressure and the separation function based on the friction between the rubber and a paper sheet can be separated. Therefore, materials having optimal functions for the respective functions can be selected.

With the structure designed to press the pressure sensitive conductive rubber via a lever, the separation function and the multiple paper-conveying error detection function can be separated to allow the use of optimal materials for the respective functions. In addition, by setting a proper lever ratio, an optimal pressed state for both the separation function and the multiple paper-conveying error detection function can be easily set.

By distributing pressures to the pressure sensitive conductive rubber and the auxiliary spring, the degree of freedom in setting an optimal pressed state for both the separation function and the multiple paper-conveying error detection function can be increased. If, for example, a region in which a change in resistance value with a change in displacement amount is sufficiently larger can be obtained only when an initial pressure is applied, a proper detection response can be obtained by pressing the separation pad using the auxiliary spring.

With the arrangement allowing adjustment of the pressure or the thickness of the pressure sensitive conductive rubber in a pressed state, even if the detection response is shifted from the optimal region owing to fatigue over time, the pressed state of the pressure sensitive conductive rubber can be restored to the condition capable of an optimal response. At the same time, it is obvious that the degree of freedom of conditions for initialization is increased.

Both the separation function based on friction and the detection function based on the pressure sensitive conductive rubber can be ensured.

Both the separation function based on friction and the multiple paper-conveying detection function based on the pressure sensitive conductive rubber can be ensured. In addition, since the two functions are realized by different members, if one of the members wears out, only the worn member needs to be replaced, thus providing an economical advantage. Furthermore, since different members can be used to press the separation pad member, constituted by a friction member, and the pressure sensitive conductive rubber, optimal pressures for frictional separation and detection of a multiple paper-conveying error can be set.

By arranging a plurality of pressure sensitive conductive rubbers or conductive layer in the widthwise direction, a skew of a sheet can be detected.

By detecting a multiple paper-conveying error with reference to the first paper sheet, any types of paper sheets inserted in the feeder can be handled. However, in the method of storing reference data in a memory, the types of paper sheets to be handled are limited by the capacity of the memory. According to the present invention, since there is no need to perform a cumbersome operation of temporarily storing reference data in a memory, the load on a user can be reduced.

A multiple paper-conveying error can be detected by comparing the detected value of the thickness of the first paper sheet with that of the second paper sheet.

If the reference data is not updated upon detection of a multiple paper-conveying error of the first paper sheet, detection cannot be performed after the feeding operation is restarted. The present invention can solve such a problem.

According to the present invention, when all the paper sheets on the feeding table are fed, the reference paper sheet data is cleared. With this operation, any types of paper sheets inserted in the feeder can be handled. Even if a set of paper sheets including different types of paper sheets are inserted in the feeder, accurate detection can be performed because no previous data is set as reference data.

If data of the first paper sheet is stored, as reference data, in a storage means, when the second or subsequent paper sheet undergoes a multiple paper-conveying error, there is no need to perform a cumbersome operation of updating the reference data. In addition, when the feeding operation is restarted after the occurrence of a multiple paper-conveying error, multiple paper-conveying of the first paper sheet can be detected. That is, a multiple paper-conveying error can be detected at an early stage in a feeding operation.

According to the present invention, the number of paper sheets which have passed through the separation function is counted so that when the second or subsequent paper sheets undergoes a multiple paper-conveying error, the count value set before the occurrence of the multiple paper-conveying error can be displayed. With this operation, the feeding operation can be restarted from the stage where the multiple paper-conveying error has occurred. That is, the feeding operation need not be restarted from the first paper sheet. Therefore, the load on a user can be reduced.

If reference data is stored in a memory to detect a conveyed state of each paper sheet, detection of multiple paper-conveying of the first paper sheet need not be performed by comparison with the second or subsequent paper sheet. That is, when the first paper sheet undergoes a multiple paper-conveying error, the error can be immediately detected.

By storing reference data in a memory in accordance with the type of paper sheet to be handled, a plurality of types of paper sheets can be handled.

Assume that paper sheets to be handled are limited to one type as in the case of slips or securities. In this case, once the corresponding data is stored, a user need not input reference data again. In addition, a multiple paper-conveying error can be detected at low cost without using a complicated circuit as in a case wherein a RAM is used.

Accurate detection of a multiple paper-conveying error can be realized by performing detection when separation is performed by the separation pad, and only one paper sheet is fetched by the separation pad.

According to the present invention, the thickness of one paper sheet is sampled a plurality of number of times, and the maximum value is stored, as reference data, in the memory. That is, the maximum thickness of one paper sheet is detected. With this operation, even if the thickness of a paper sheet partly changes during a multiple paper-conveying period, a multiple paper-conveying error can be detected.

A detector for detecting an open/closed state of the feeding mechanism can be omitted by using a detection output, obtained when the pressure sensitive conductive rubber is pressed while the feeding mechanism is in an operative state, i.e., a closed state, as a reference value.

When the feeder is operated while the feeding mechanism is in an open state, an operation error may be caused. For example, a user may injured by irradiation. Such an accident can be prevented by stopping a feeding operation while the feeding mechanism is in an open state.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A paper sheet feeding apparatus comprising:

a table for placing a plurality of paper sheets;

pickup means for picking up the paper sheets placed on said table;

roller means for feeding the paper sheets picked up by said pickup means;

separation means, which contacts with said roller means, for separating the paper sheets fed by said roller means, said separation means including a pressure sensitive conductive member, said pressure sensitive conductive member being formed of a pressure-sensitive and electrically-conductive material that has an electrical resistance value which changes in accordance with a pressure condition indicating how the pressure sensitive conductive member is pressed by the paper sheets; and means for detecting a condition of the paper sheets fed by said roller means, in accordance with the electrical resistance value of said pressure sensitive conductive member.

2. The apparatus of claim 1, wherein said separation means includes:

a support plate, having an electrical conductivity, for pressing the pressure sensitive conductive member against said roller means; and signal detector means, provided at said support plate, for detecting a signal indicating a change in the electrical resistance value of said pressure sensitive conductive member.

3. The apparatus of claim 1, wherein said separation means includes:

a friction member for separating the paper sheets; and an electrode layer formed between said friction member and said pressure sensitive conductive member.

4. The apparatus of claim 1, wherein said separation means includes:

a friction member for separating the paper sheets; and a conductive layer made of a conductive material formed between said friction member and said pressure sensitive conductive member.

5. The apparatus of claim 1, wherein said separation means includes:

means for axially-supporting a friction member for separating the paper sheets so that said friction member is allowed to be rotated around a specific point, and applies a pressure to said pressure sensitive conductive member connected through a lever in accordance with an amount of movement of said friction member.

6. The apparatus of claim 1, wherein said detecting means includes:

first detection means for detecting an electrical signal corresponding to a change in the electrical resistance value of said pressure sensitive conductive member;

second detection means for detecting a thickness of the paper sheet fed by said roller means based on the electrical signal detected by said first detection means; and third detection means for detecting that two or more of the paper sheets fed by said roller means are simultaneously conveyed.

7. The apparatus of claim 1, wherein said detecting means includes:

first detection means for detecting an electrical signal corresponding to a change in the electrical resistance value of said pressure sensitive conductive member;

second detection means for detecting a thickness of the paper sheet fed by said roller means based on the electrical signal detected by said first detection means;

memory means for storing as reference data a thickness of a first one of the paper sheets, detected by said second detection means; and third detection means for detecting that two or more of the paper sheets fed by said roller means are simultaneously conveyed, by comparing a thickness of a second or subsequent one of the paper sheets, detected by said second detection means, with the reference data stored in said memory means.

8. The apparatus of claim 1, wherein said detecting means includes:

first detection means for detecting an electrical signal corresponding to a change in the electrical resistance value of said pressure sensitive conductive member;

second detection means for detecting a thickness of the paper sheet fed by said roller means based on the electrical signal detected by said first detection means;

memory means for storing a as reference data a thickness of a first one of the paper sheets, detected by said second detection means;

third detection means for detecting that two or more of the paper sheets fed by said roller means are simultaneously conveyed, by comparing a thickness of a second or subsequent one of the paper sheets, detected by said second detection means, with the reference data stored in said memory means;

means for updating contents of said memory means when said third detection means detects that the first two or more of the paper sheets are simultaneously conveyed; and means for holding the contents of said memory means when said third detection means detects that the second or subsequent two or more of the paper sheets are simultaneously conveyed.

9. The apparatus of claim 1, wherein said detecting means includes:

means for converting a change in the electrical resistance value of said pressure sensitive conductive member into an electrical signal having a value corresponding to the change in the electrical resistance value;

peak detection means for detecting a peak value of the electrical signal obtained by said converting means;

thickness detection means for detecting a thickness value of the paper sheet fed by said roller means based on the peak value detected by said peak detection means; and means for detecting that two or more of the paper sheets fed by said roller means are simultaneously conveyed, in accordance with the peak value detected by said peak detection means and the thickness value detected by said thickness detection means.

10. The apparatus of claim 1, wherein said detecting means includes:

means for converting a change in the electrical resistance value of said pressure sensitive conductive member into an electrical signal having a value corresponding to the change in the electrical resistance value;

thickness detection means for detecting a thickness value of the paper sheet fed by said roller means based on the electrical signal obtained by said converting means;

memory means for storing reference data for the thickness of the paper sheets in advance; and means for detecting that two or more of the paper sheets fed by said roller means are simultaneously conveyed, by comparing the thickness value of the paper sheet, detected by said thickness detection means, with the reference data stored in said memory means.

11. The apparatus of claim 1, wherein said table includes means for storing a plurality of originals as the paper sheets;

said pickup means includes means for fetching each of the originals stored in said storage means one by one;

said roller means includes rotating means, having a rotating shaft, for rotating around the rotating shaft so as to feed the originals fetched up by said fetching means;

said separation means includes isolating means, which is kept in contact with said rotating means and is rotated in a reverse direction to a rotation direction the rotating shaft of said rotating means, for isolating a second or subsequent one of the originals fetched by said fetching means from a first one of the originals; and output means, having the pressure sensitive conductive member whose resistance value change in accordance with a pressure applied to the pressure sensitive conductive member and coupled to the rotating shaft of said rotating means, for outputting a change in the resistance value of said pressure sensitive conductive member in accordance with a pressure generated upon feeding of the original.

12. The apparatus of claim 1, wherein said table includes means for storing a plurality of originals as the paper sheets;

said pickup means includes means for fetching each of the originals stored in said storage means one by one;

said roller means includes rotating means, having a rotating shaft, for rotating around the rotating shaft so as to feed the originals fetched up by said fetching means; and said separation means includes isolating means, which is kept in contact with said rotating means and is rotated in a reverse direction to a rotation direction the rotating shaft of said rotating means, for isolating a second or subsequent one of the originals fetched by said fetching means from a first one of the originals;

means for stacking the pressure sensitive conductive member and a conductive material formed on an outer surface of the pressure sensitive conductive member; and means for providing information of a pressure, generated upon feeding of the original fed between said separation means and said roller means and indicating a change in the electrical resistance value of said pressure sensitive conductive member.

13. The apparatus of claim 1, wherein said table includes means for storing a plurality of originals as the paper sheets;

said pickup means includes means for fetching each of the originals stored in said storage means one by one;

said roller means includes rotating means, having a rotating shaft, for rotating around the rotating shaft so as to feed the originals fetched up by said fetching means;

said separation means includes isolating means, which is kept in contact with said rotating means and is rotated in a reverse direction to a rotation direction the rotating shaft of said rotating means, for isolating a second or subsequent one of the originals fetched by said fetching means from a first one of the originals, said isolating means being formed by stacking pressure sensitive conductive members, each of whose resistance value changes in accordance with a pressure applied to the pressure sensitive conductive member, and conductive layers of conductive material, so that a plurality of the conductive layers and a plurality of the pressure sensitive conductive members are arranged to be isolated from each other in a direction perpendicular to the rotation direction of said rotating means; and means for providing information of a pressure, generated upon feeding of the original fed between said separation means and said roller means and indicating a change in the electrical resistance value of said pressure sensitive conductive members.

14. The apparatus of claim 1, wherein said table includes means for storing a plurality of originals as the paper sheets;

said pickup means includes means for fetching each of the originals stored in said storage means one by one;

said roller means includes rotating means, having a rotating shaft, for rotating around the rotating shaft so as to feed the originals fetched up by said fetching means;

said separation means includes isolating means, which is kept in contact with said rotating means and is rotated in a reverse direction to a rotation direction the rotating shaft of said rotating means, for isolating a second or subsequent one of the originals fetched by said fetching means from a first one of the originals, said isolating means being formed by stacking pressure sensitive conductive members, each of whose resistance value changes in accordance with a pressure applied the pressure sensitive conductive member, and conductive layers of conductive material, so that either of a set of the conductive layers, or a set of conductive layers with the pressure sensitive conductive members, are arranged to be isolated from each other in a direction perpendicular to the rotation direction of said rotating means; and means for providing information of a pressure, generated upon feeding of the original fed between said separation means and said roller means and indicating a change in the electrical resistance value through said pressure sensitive conductive members.

15. The apparatus of claim 1, further comprising:

means for performing an operation of feeding the paper sheets in accordance with the condition detected by said detecting means.

16. A paper sheet feeding apparatus comprising:

a table for placing a plurality of paper sheets;

pickup means for picking up the paper sheets placed on said table;

roller means for feeding the paper sheets picked up by said pickup means;

separation means, which contacts with said roller means, for separating the paper sheets fed by said roller means, said separation means including a pressure sensitive conductive member having an electrical resistance value which changes in accordance with a pressure condition indicating how the pressure sensitive conductive member is pressed by the paper sheets;

means for detecting a condition of the paper sheets fed by said roller means, in accordance with the electrical resistance value of said pressure sensitive conductive member;

wherein said separation means includes:

a support plate, having an electrical conductivity, for pressing the pressure sensitive conductive member against said roller means; and signal detector means, provided at said support plate, for detecting a signal indicating a change in the electrical resistance value of said pressure sensitive conductive member.

17. A paper sheet feeding apparatus comprising:

a table for placing a plurality of paper sheets;

pickup means for picking up the paper sheets placed on said table;

roller means for feeding the paper sheets picked up by said pickup means;

separation means, which contacts with said roller means, for separating the paper sheets fed by said roller means, said separation means including a pressure sensitive conductive member having an electrical resistance value which changes in accordance with a pressure condition indicating how the pressure sensitive conductive member is pressed by the paper sheets;

means for detecting a condition of the paper sheets fed by said roller means, in accordance with the electrical resistance value of said pressure sensitive conductive member;

wherein said separation means includes:

a friction member for separating the paper sheets; and an electrode layer formed between said friction member and said pressure sensitive conductive member.

* * * * *